US011160711B2

(12) United States Patent
Hirayama

(10) Patent No.: US 11,160,711 B2
(45) Date of Patent: Nov. 2, 2021

(54) CORRUGATED CARDBOARD COFFIN

(71) Applicant: Nihon Coffin Co., Ltd., Hiroshima (JP)

(72) Inventor: Yahiro Hirayama, Hiroshima (JP)

(73) Assignee: NIHON COFFIN CO., LTD., Hiroshima (JP)

( * ) Notice: Subject to any disclaimer, the term of this patent is extended or adjusted under 35 U.S.C. 154(b) by 0 days.

(21) Appl. No.: 16/852,961

(22) Filed: Apr. 20, 2020

(65) Prior Publication Data

US 2020/0383859 A1 Dec. 10, 2020

(30) Foreign Application Priority Data

Jun. 10, 2019 (JP) ..... JP2019-108057

(51) Int. Cl.
*A61G 17/007* (2006.01)
*A61G 17/04* (2006.01)

(52) U.S. Cl.
CPC ..... *A61G 17/0073* (2013.01); *A61G 17/042* (2016.11)

(58) Field of Classification Search
CPC ..... A61G 17/0073; A61G 17/007; A61G 17/004; A61G 17/034; A61G 17/042
USPC ..... 27/4, 19
See application file for complete search history.

(56) References Cited

U.S. PATENT DOCUMENTS 5,815,898 A * 10/1998 Jenkins ..... A61G 17/004 27/4
6,105,220 A * 8/2000 Belanger ..... A61G 17/0073 27/4
6,317,944 B1 * 11/2001 Beaulieu ..... A61G 17/034 27/4
6,640,401 B2 * 11/2003 Chen ..... A61G 17/007 27/4
2003/0093886 A1 * 5/2003 Chen ..... A61G 17/007 27/4
2005/0125974 A1 * 6/2005 Ozbun ..... A61G 17/007 27/19
2012/0042488 A1 * 2/2012 Hsu ..... A61G 17/0073 27/4
2014/0352120 A1 * 12/2014 Hui ..... A61G 17/034 27/14

FOREIGN PATENT DOCUMENTS

JP 3135128 U 9/2007
JP 2009-285192 A 12/2009

* cited by examiner

*Primary Examiner* — William L Miller
(74) *Attorney, Agent, or Firm* — Pearne & Gordon LLP

(57) ABSTRACT

The present disclosure is a corrugated cardboard coffin including: a pair of sidewalls extending in a longitudinal direction of the coffin; a bottom board connecting the pair of sidewalls; and a first board disposed in each gable of the coffin. The first board extends in an extending direction of the gable, and includes a second board and a third board extending in the extending direction of the sidewalls. The first board, the second board, and the third board can be housed between the bottom board and the sidewalls.

9 Claims, 27 Drawing Sheets

CORRUGATED CARDBOARD COFFIN

FIELD

The present invention relates to a coffin made of corrugated cardboard.

BACKGROUND

As a coffin for storing a dead body, as shown in Patent Literature 1, the coffin made of wood such as paulownia has been used for a long time. Recently, the coffin made of corrugated cardboard instead of wood has been proposed as shown in Patent Literature 2.

CITATION LIST

Patent Literature

Patent Literature 1: Japanese Patent Application Laid-open No. 2009-285192

Patent Literature 2: Japanese Utility Model Registration No. 3135128

SUMMARY

Technical Problem

The coffin of Patent Literature 1 can be made compact by pulling out boards, which ware inserted into gables, and folding sidewalls inwardly thereof when the coffin is stored or transported. A board in a gable is fixed by being inserted into a guide provided on the sidewalls. This structure is based on a premise that the coffin is made of wood. If such a structure is adopted in the coffin made of corrugated cardboard, there is a possibility that a gap will be formed at a contact point between the corrugated cardboards or flexure is formed around the guide. Therefore, in the coffin made of corrugated cardboard, it may be inappropriate to adopt such a structure.

The coffin made of corrugated cardboard of Patent Literature 2 has U-shaped members (the members denoted by reference numeral 4) arranged in the gables of the coffin. Patent Literature 2 describes that the U-shaped members are developed outwardly of the coffin. When the coffin is developed in this way, there is the problem that a bulk of the coffin increases when the coffin is stored or transported.

An object of the present invention is to provide a coffin made of corrugated cardboard that can be compactly folded during storage, transportation and the like, and can be assembled or folded by rotating members constituting the coffin.

Solution to Problem

The above problems are solved by a foldable corrugated cardboard coffin. The corrugated cardboard coffin includes: a pair of sidewalls extending in a longitudinal direction of the coffin; a bottom board connecting the pair of sidewalls; and a first board disposed in each gable of the coffin. The first board extends in an extending direction of the gable, and includes a second board and a third board extending in the extending direction of the sidewalls. The pair of sidewalls are rotatable in a direction approaching the bottom board. The first board is supported by the bottom board so as to be rotatable in the direction approaching the bottom board. The second board and the third board are supported by the first board so as to be rotatable in a direction approaching one surface or the other surface of the first board. The first board, the second board, and the third board can be housed between the bottom board and the sidewalls when the second board and the third board are rotated in the direction approaching one surface or the other surface of the first board, the first board is rotated in the direction approaching the bottom board, and the sidewalls are rotated in the direction approaching the bottom board. Since the first board, the second board, the third board, and the sidewalls can be folded by rotation, the coffin can be compactly folded during storage and transportation, and seams between the corrugated cardboards are reduced, so that the gap and flexure are less likely formed.

It is preferred that a center of rotation operation on each of the sidewalls is disposed away from the bottom board, the sidewall extends from the center, and the first board, the second board, and the third board can be housed in a space formed between the bottom board and the sidewalls fell to the bottom board. By providing the center of the rotation operation on the sidewall at a position away from the bottom board, the sidewalls can be folded between the two ends of the sidewalls, and the first board, the second board, and the third board can be housed in a stable state between the bottom board and the sidewalls.

In the corrugated cardboard coffin described above, it is preferred that a portion by which the sidewall, the first board, the second board, or the third board rotates is provided with a cutout portion in the corrugated cardboard constituting the coffin. With a structure by which the corrugated cardboard is rotated at the cutout portion, a member such as a hinge is not required, so that the structure can be simplified, and appearance of a rotating portion can be beautifully finished without the gap.

In the corrugated cardboard coffin described above, an exterior material may be fixed to the outside of the first board disposed in each of the gables, and the first board may function as a reinforcement. Furthermore, the first board may appear on an exterior of the coffin, so that the first board disposed in the gable can function as the exterior material that closes the gable.

In the corrugated cardboard coffin described above, it is preferred that, in an assembled state of the coffin, the first board extends upwardly of the coffin, the second board and the third board extend in the longitudinal direction of the coffin, the second board and the one sidewall are connected to each other, and the third board and the other sidewall are connected to each other. By connecting the second board or the third board and the sidewall, rigidity of the coffin can be improved.

Advantageous Effects of Invention

According to the present invention, it is possible to provide the coffin made of corrugated cardboard that can be compactly folded during storage, transportation and the like, and can be assembled or folded by rotating the members constituting the coffin.

DESCRIPTION OF EMBODIMENTS

Figure 25:
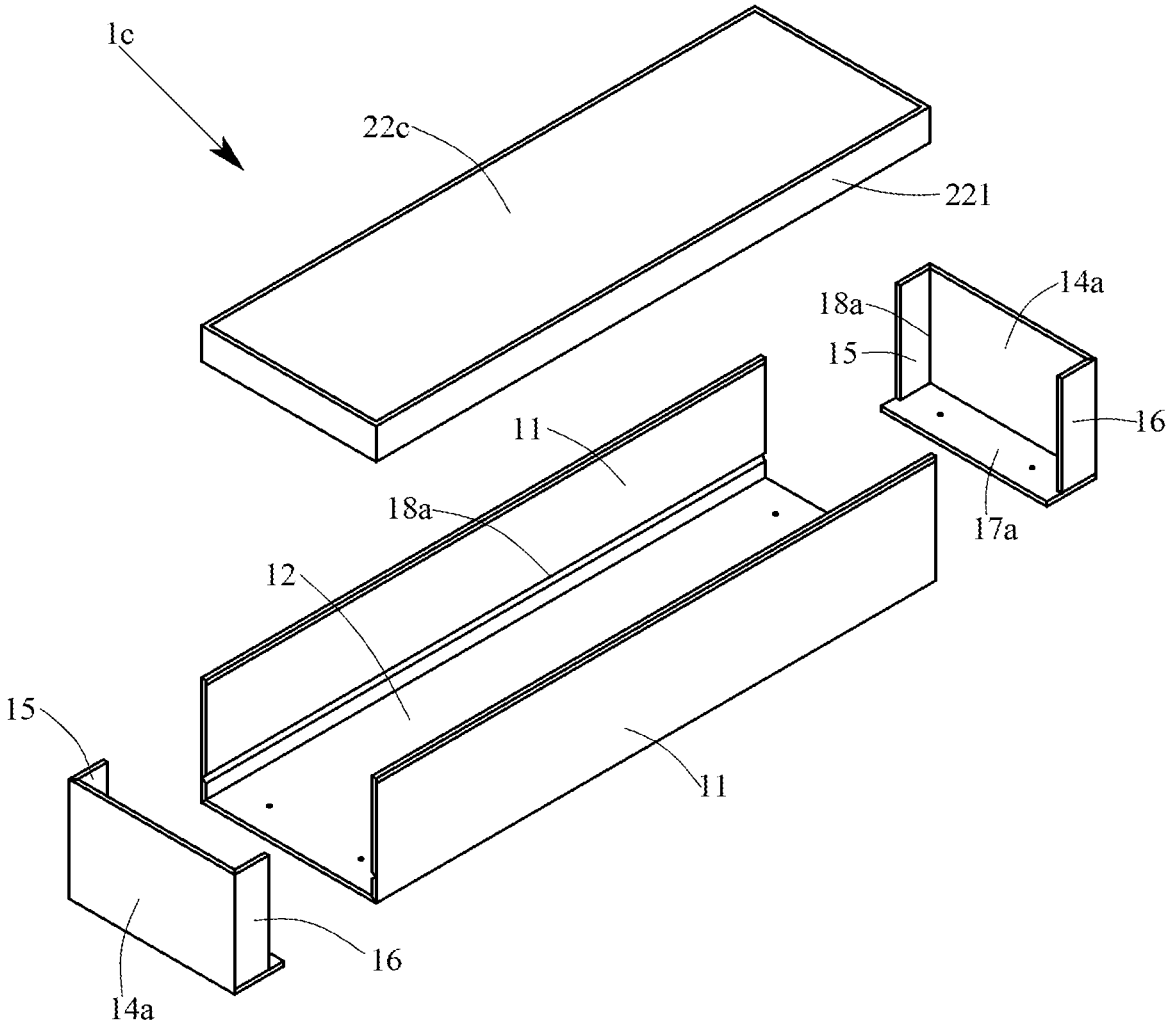
FIG. 25 is a perspective view illustrating a state in which the corrugated cardboard coffin according to a third embodiment is disassembled.

Hereinafter, embodiments of a corrugated cardboard coffin according to the present invention will be described with reference to the drawings. FIGS. 1 to 12 illustrate a first embodiment of a corrugated cardboard coffin. FIGS. 13 to 16 illustrate a second embodiment of a corrugated cardboard coffin. FIG. 25 illustrates a third embodiment of a corrugated cardboard coffin.

First Embodiment

As illustrated in FIGS. 1 to 12, a corrugated cardboard coffin 1*a* of the first embodiment (hereinafter, sometimes referred to simply as a coffin) has a pair of sidewalls 11 extending in a longitudinal direction of the coffin 1*a*, a bottom board 12 connecting the pair of sidewalls 11, and a gable 13 of the coffin 1*a*. The sidewalls 11 extend in the longitudinal direction of the coffin 1*a*, and extend upwardly of the coffin 1*a* in an assembled state of the coffin 1*a*. The bottom board 12 connects the pair of sidewalls 11. In the coffin 1*a* of the first embodiment, the pair of sidewalls 11 and the bottom board 12 form a channel shaped cross-section in the assembled state. The gable 13 becomes a quadrangular opening.

Figure 5:
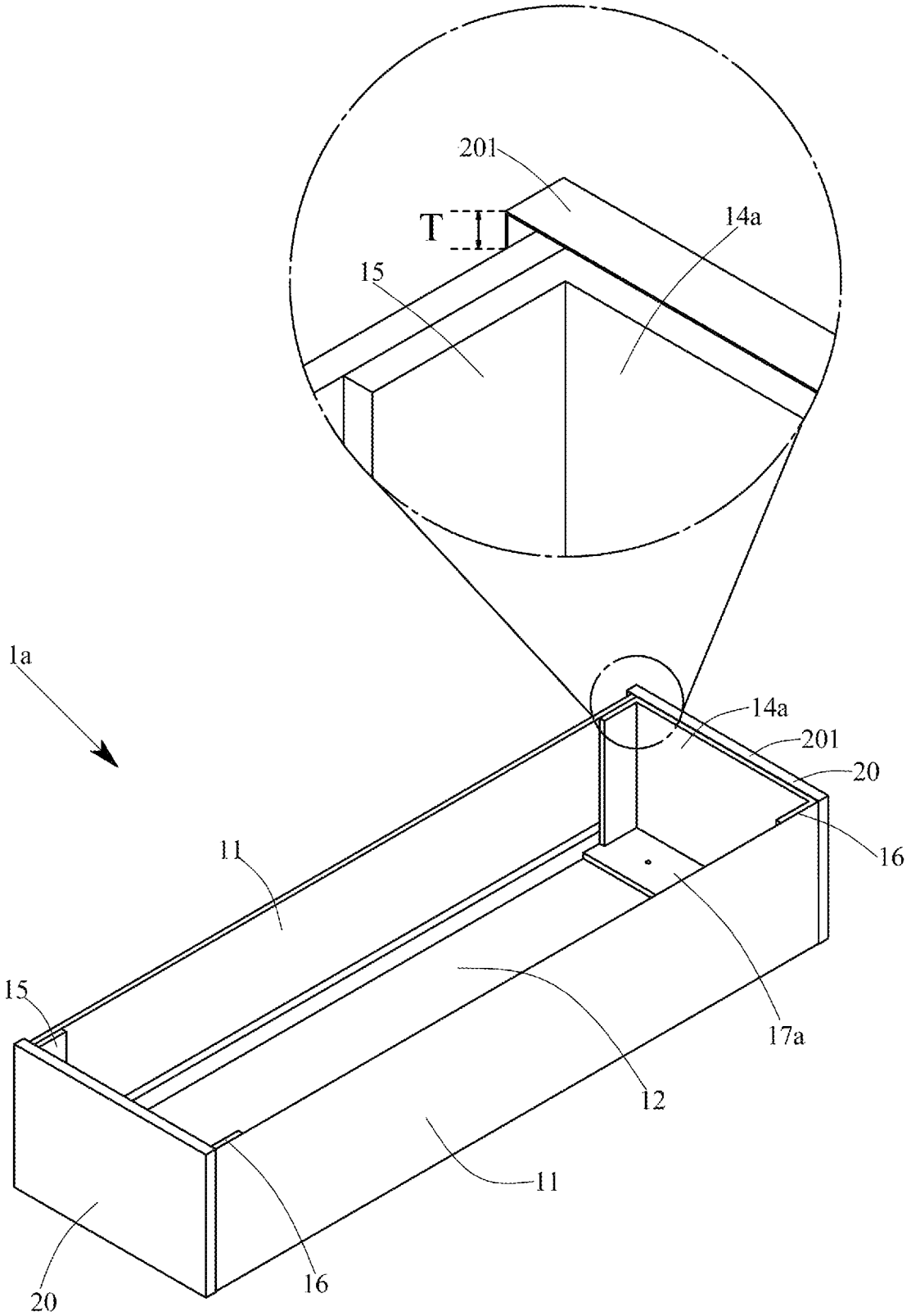
FIG. 5 is a perspective view illustrating a coffin body in an assembled state of the corrugated cardboard coffin of FIG. 1.
Figure 6:
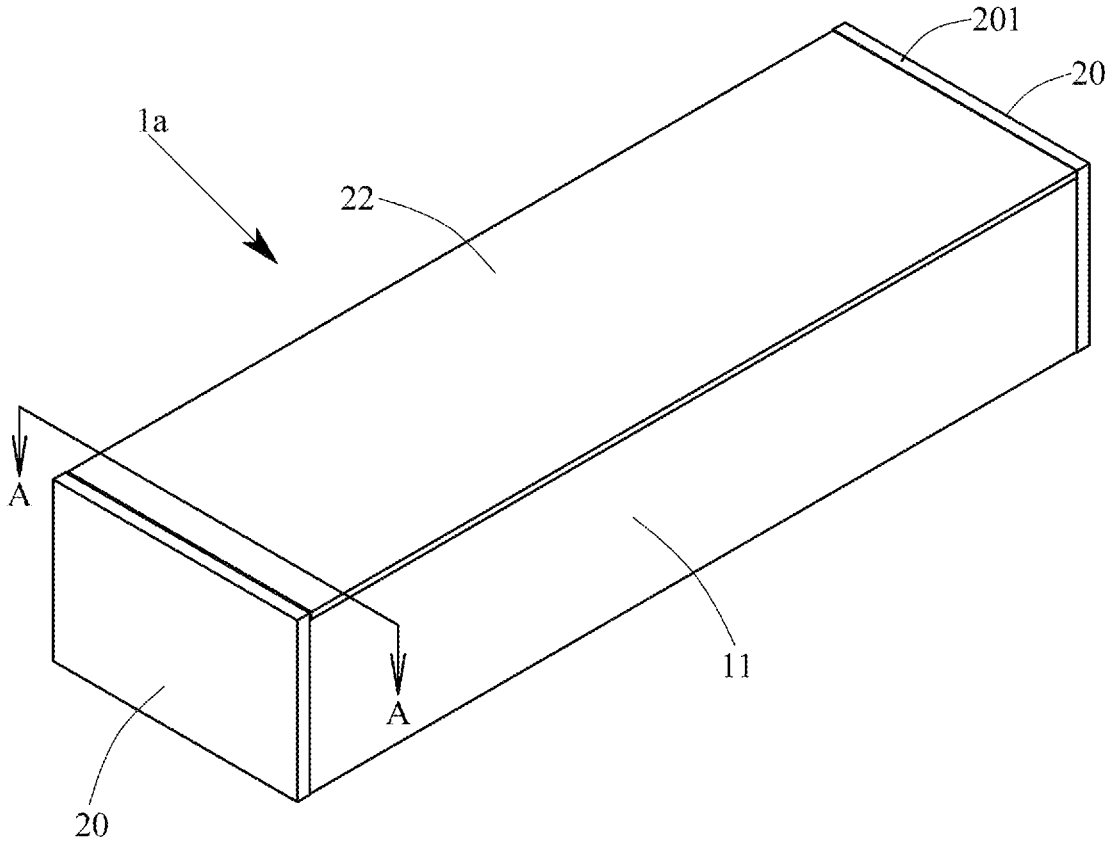
FIG. 6 is a perspective view illustrating a state in which a lid is attached to the coffin body of FIG. 5.

As illustrated in FIG. 5, first boards 14*a* are disposed in openings arranged in the gables 13 in an extending direction of the gables 13, that is, in a short direction of the coffin 1*a*. Each of the first boards 14*a* has a shape extending upwardly of the coffin in the assembled state of the coffin 1*a*. As illustrated in FIG. 5, the first board 14*a* includes a second board 15 extending in an extending direction of the sidewalls 11 and a third board 16 extending in the longitudinal direction of the coffin 1*a* in the assembled state of the coffin 1*a*.

Figure 7:
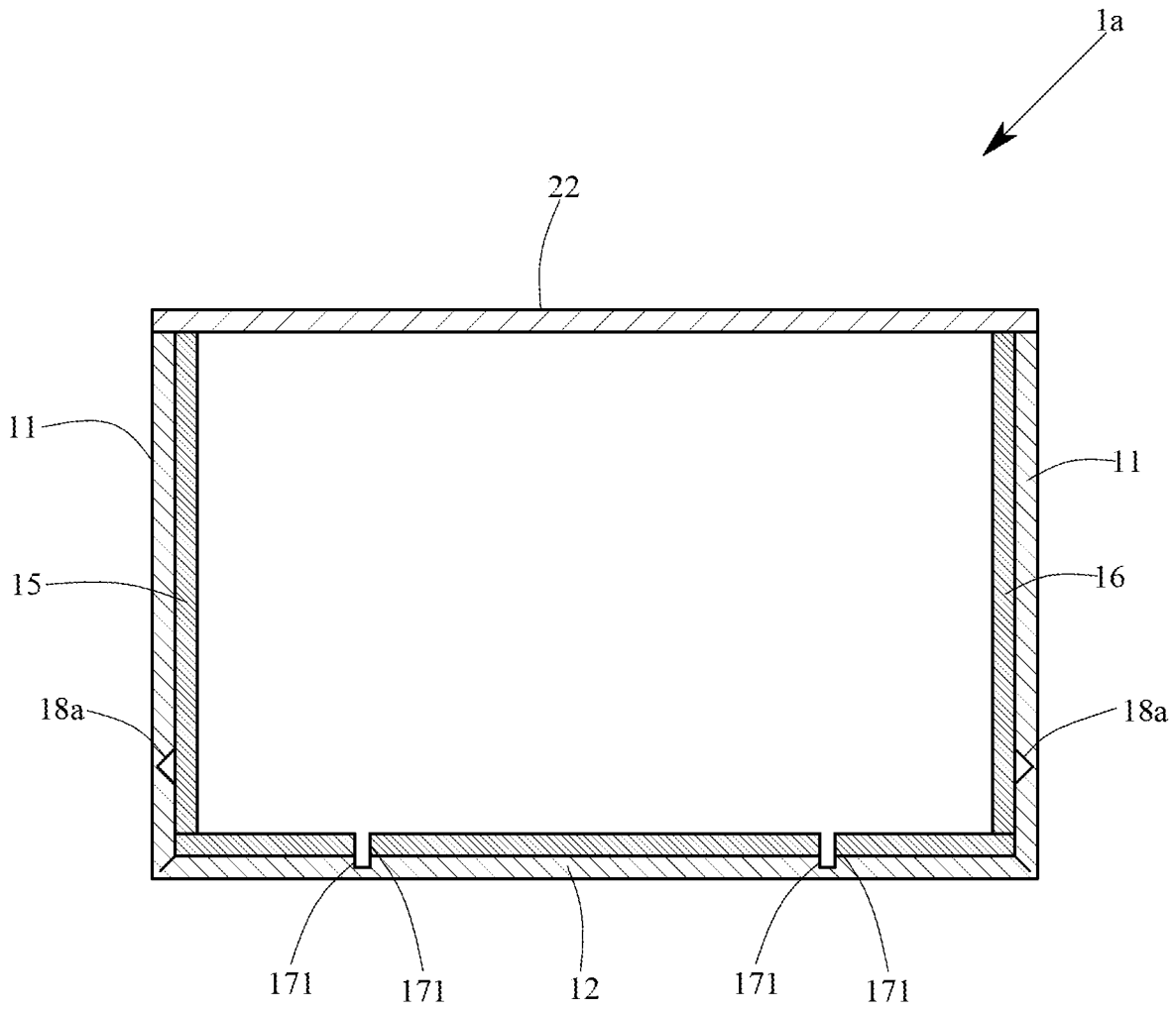
FIG. 7 is a cross-sectional view taken along a line AA in FIG. 6.

In the coffin 1*a* of the first embodiment, the second boards 15 and the third boards 16 are arranged on the left and the right ends of the first boards 14*a*, and fixing boards 17*a* are disposed as fixing portions for fixing the bottom board 12 and the first boards 14*a* at lower ends of the first boards 14*a*. The bottom board 12 and the fixing boards 17*a* can be fixed, for example, as illustrated in FIG. 7, by providing the bottom board 12 and the fixing boards 17*a* with communication holes 171, and inserting fixing tools (not illustrated) such as dowels into the communication holes. The bottom board 12 and the fixing boards 17*a* can also be fixed, for example, by an adhesive, a bonding agent such as a gluing agent, screws, or connecting tools such as dowels and dowel holes.

Figure 8:
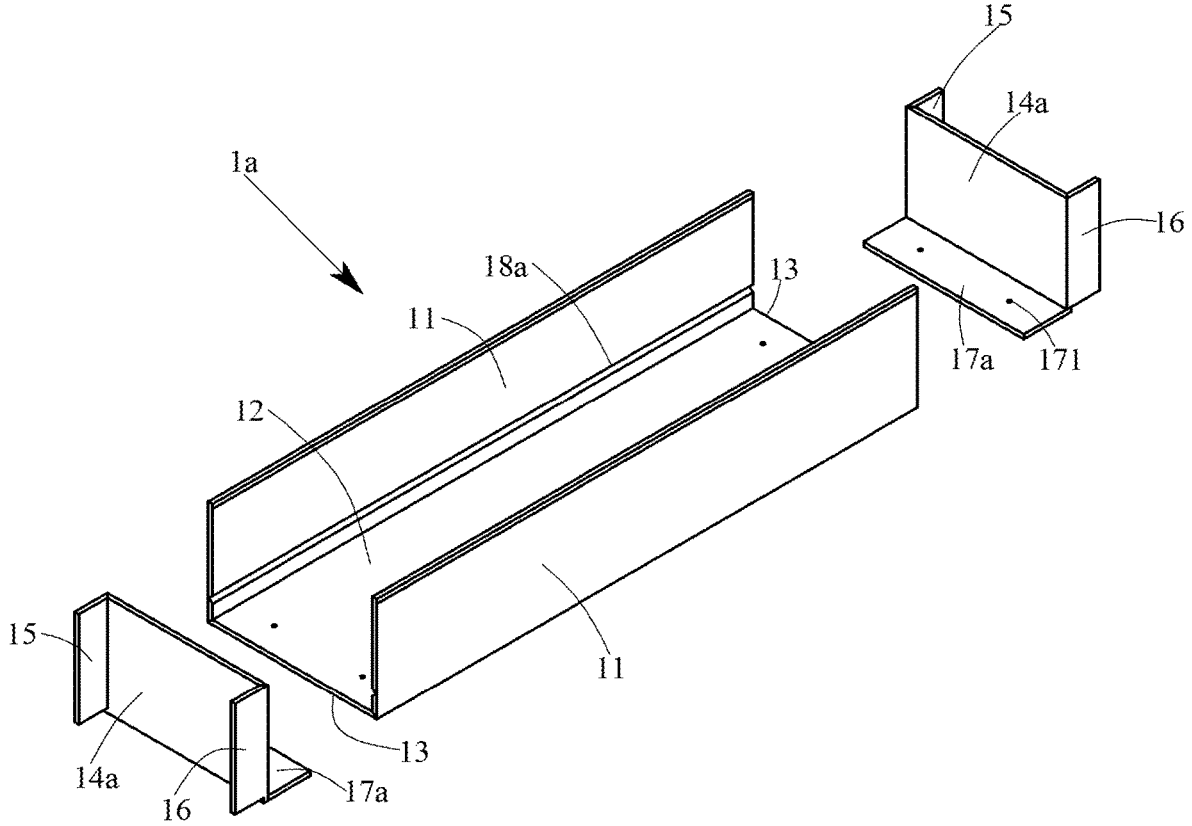
FIG. 8 is a perspective view illustrating a process in which the corrugated cardboard coffin according to the first embodiment is folded.
Figure 9:
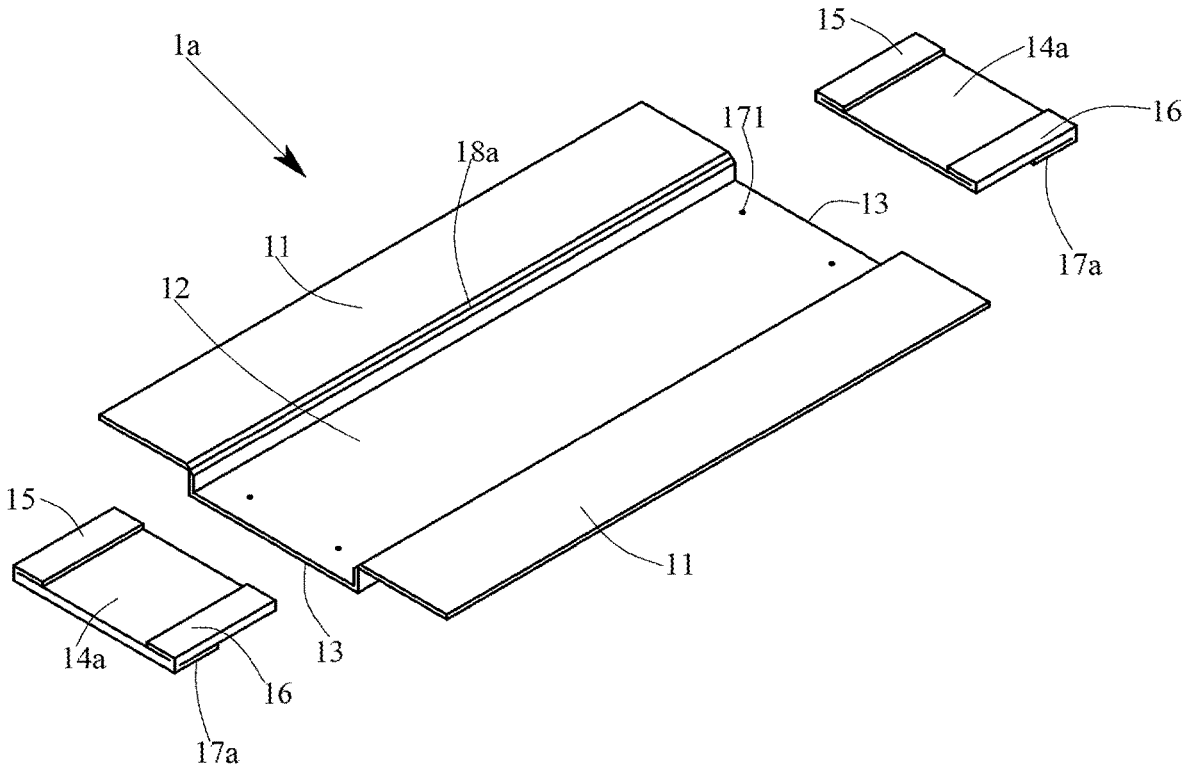
FIG. 9 is a perspective view illustrating the process in which the corrugated cardboard coffin according to the first embodiment is folded, and is the perspective view illustrating a step subsequent to FIG. 8.

As illustrated in FIGS. 8 and 9, the first boards 14*a* are supported by the bottom board 12 so as to be rotatable in a direction approaching the bottom board 12. A state of supporting includes a state in which the first boards 14*a* are supported by fixing the fixing boards 17*a* to the bottom board 12, and a state in which the first boards 14*a* are supported by the bottom board 12 by integrally forming the bottom board 12 and the first boards 14*a* as in the second embodiment described later. FIG. 8 illustrates a state in which the first boards 14*a* are separated from the bottom board 12 for convenience of explanation, however, the first boards 14*a* are supported by the bottom board 12 when actually assembled or folded. (the same applies to FIGS. 3, 4, 9, and 25). As illustrated in FIG. 5, in the state that the coffin 1*a* is assembled, the first boards 14*a* are in a state extending upwardly of the coffin 1*a*. As illustrated in FIG. 9, when folding the coffin 1*a*, the first boards 14*a* of the coffin 1*a* can be folded by rotating it in the direction approaching the bottom board 12. In the coffin 1*a*, the first boards 14*a* can be rotated until the first boards 14*a* contact the bottom board 12.

Figure 1:
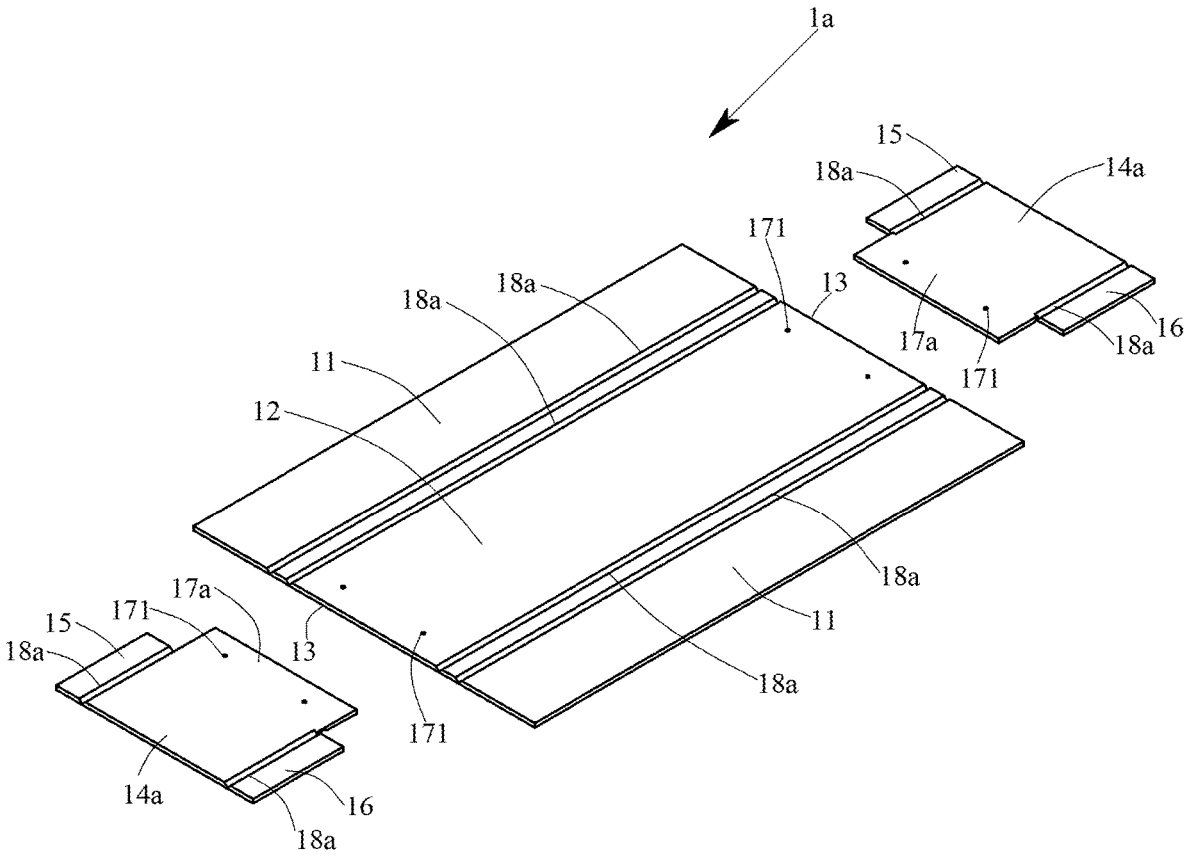
FIG. 1 is a development view illustrating a state in which an obverse of a corrugated cardboard coffin according to a first embodiment is disassembled.
Figure 4:
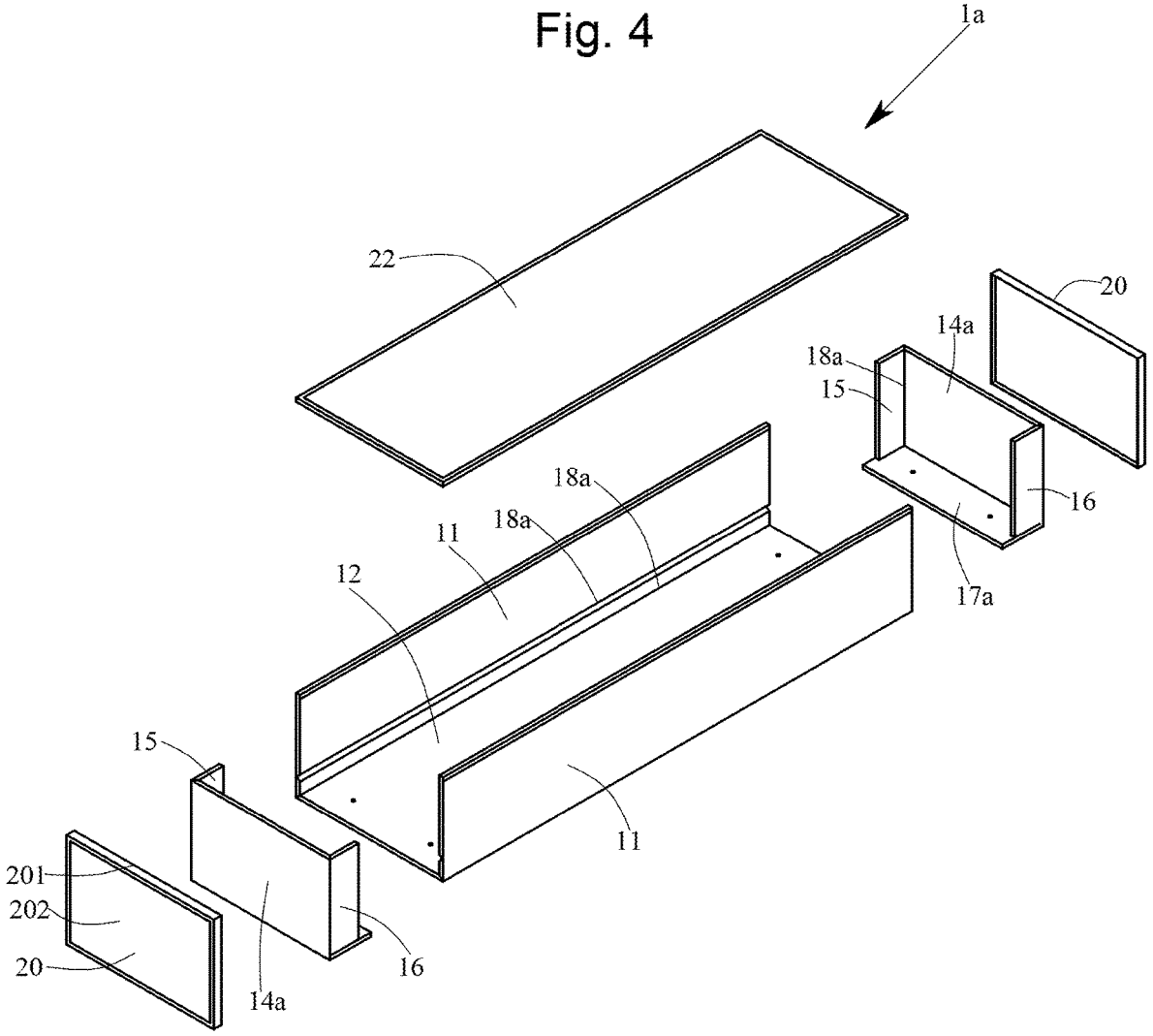
FIG. 4 is a perspective view illustrating the process of assembling the corrugated cardboard coffin of FIG. 1, and is the perspective view illustrating a step subsequent to FIG. 3.

As can be seen from the comparison of the shapes of the second boards 15 of FIGS. 1 and 4 and the comparison of the shapes of the second boards 15 of FIGS. 1, 8 and 9, each of the second boards 15 is supported by the corresponding first board 14*a* so as to be rotatable in a direction approaching one surface or the other surface of the first board 14*a*. Similarly, each of the third boards 16 is supported by the corresponding first board 14*a* so as to be rotatable in the direction approaching the one surface or the other surface of the first board 14*a*. As illustrated in FIG. 5, in the assembled state of the coffin 1*a*, the second boards 15 and the third boards 16 extend in the longitudinal direction of the coffin 1*a*. When folding the coffin 1*a*, as illustrated in FIGS. 8 and 9, each of the second boards 15 and the third boards 16 can be folded by rotating in the direction approaching the other surface of the corresponding first board 14*a*. In the coffin 1*a*, each of the second boards 15 and the third boards 16 can be rotated until the boards contact the other surface of the corresponding first board 14*a*. In an example of FIG. 9, each of the second boards 15 and the third boards 16 is rotated until the boards contact the other surface of the corresponding first board 14*a*, however, the second board 15 and the third board 16 may be rotated until the boards contact the one surface of the corresponding first board 14*a*. In an example of FIG. 1, the one surface of each of the first boards 14*a* corresponds to an obverse of the first board 14*a*, and the other surface of the first board 14*a* corresponds to a verso of the first board 14*a*. As illustrated in FIG. 1, the obverse refers to a surface facing upwardly of the coffin when the coffin is developed.

Figure 10:
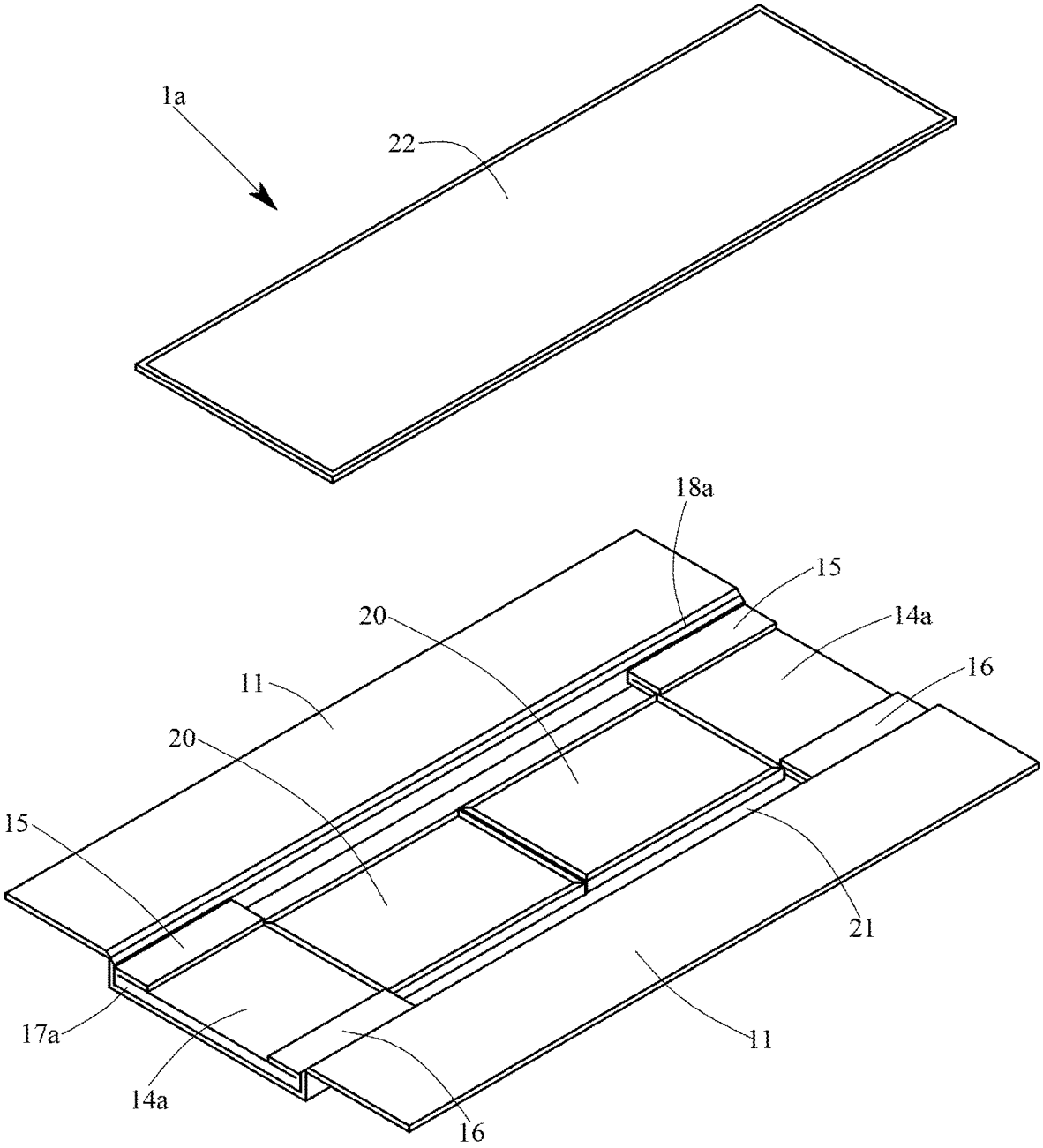
FIG. 10 is a perspective view illustrating the process in which the corrugated cardboard coffin according to the first embodiment is folded, and is the perspective view illustrating a step subsequent to FIG. 9.
Figure 11:
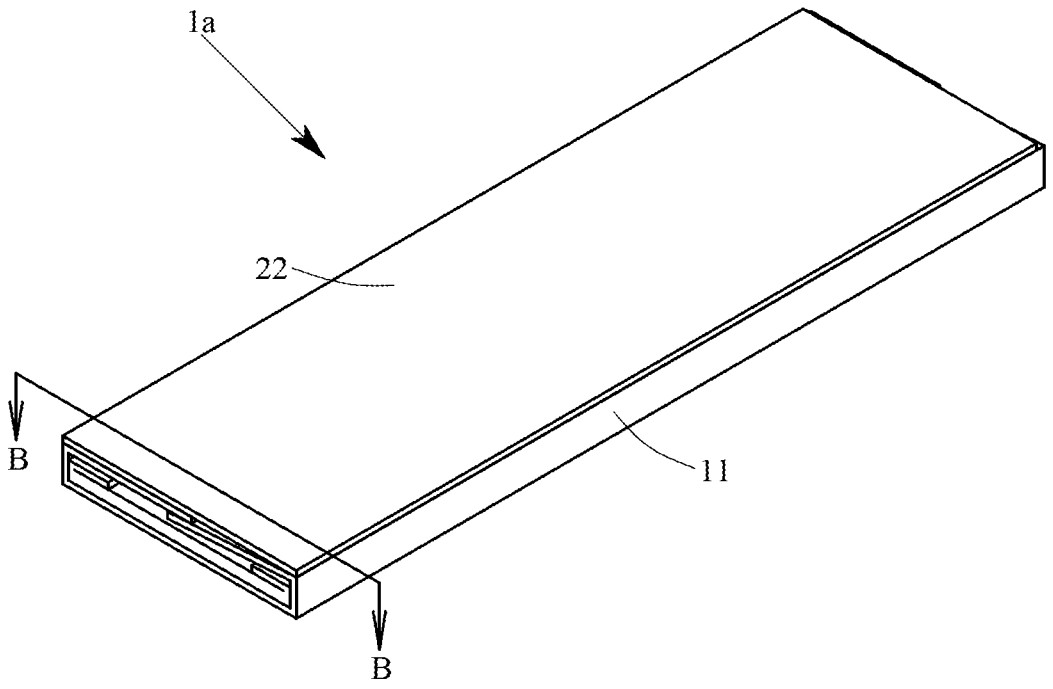
FIG. 11 is a perspective view illustrating the process in which the corrugated cardboard coffin according to the first embodiment is folded, and is the perspective view illustrating a step subsequent to FIG. 10.
Figure 12:
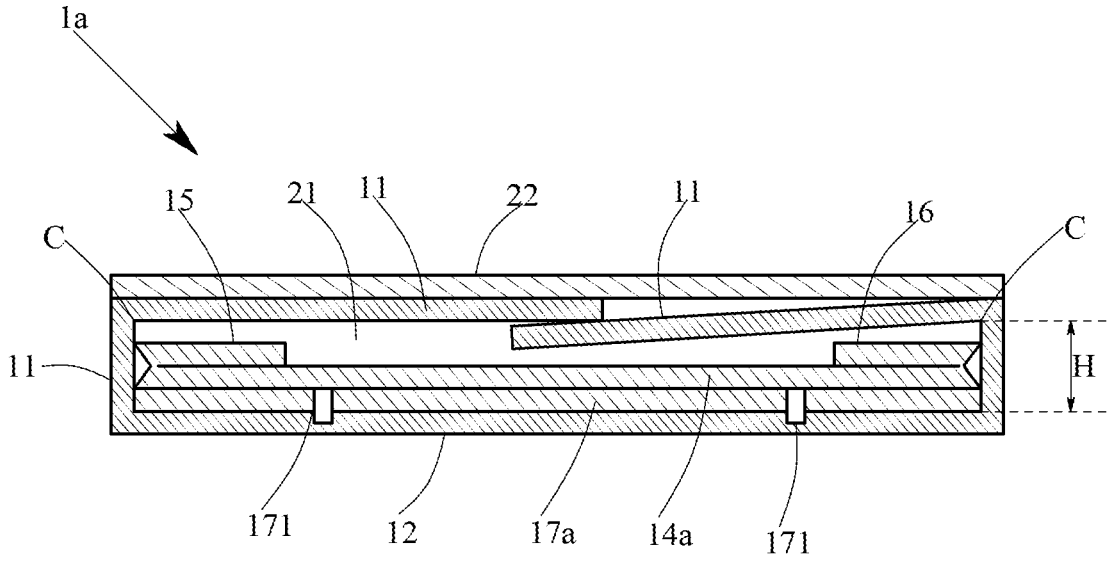
FIG. 12 is a cross-sectional view taken along a line BB in FIG. 11.

As can be seen from a difference in the shapes of the sidewalls 11 in FIGS. 9 to 11, the pair of sidewalls 11 can also be rotated in the direction approaching the bottom board 12. Therefore, the first boards 14*a*, the second boards 15, and the third boards 16 can be housed between the bottom board 12 and the sidewalls 11 when each of the second boards 15 and the third boards 16 is rotated in the direction approaching one surface or the other surface of the corresponding first board 14*a*, the first boards 14*a* are rotated in the direction approaching the bottom board 12, and the sidewalls 11 are rotated in the direction approaching the bottom board 12, as illustrated in FIGS. 11 and 12. Thus, it is possible to compactly fold the coffin 1*a* when the coffin 1*a* is stored or transported.

In the coffin 1*a* of the first embodiment, the one surface of each of the first boards 14*a* is rotated in the direction approaching the bottom board 12, and the second board 15 and the third board 16 are rotated to approach the other surface of the first board 14*a*. Therefore, since the second board 15 and the third board 16 are less likely to interfere with other members such as the bottom board 12, the coffin 1*a* has a shape to be easily folded. When the first board 14*a* is seen from a plane with the second board 15 and the third board 16 being folded, it is a shape in which the second board 15 and the third board do not protrude from an edge of the first board 14*a*, so that the second board 15 and the third board 16 are less likely to interfere with other members such as the sidewalls 11 when folded.

Figure 2:
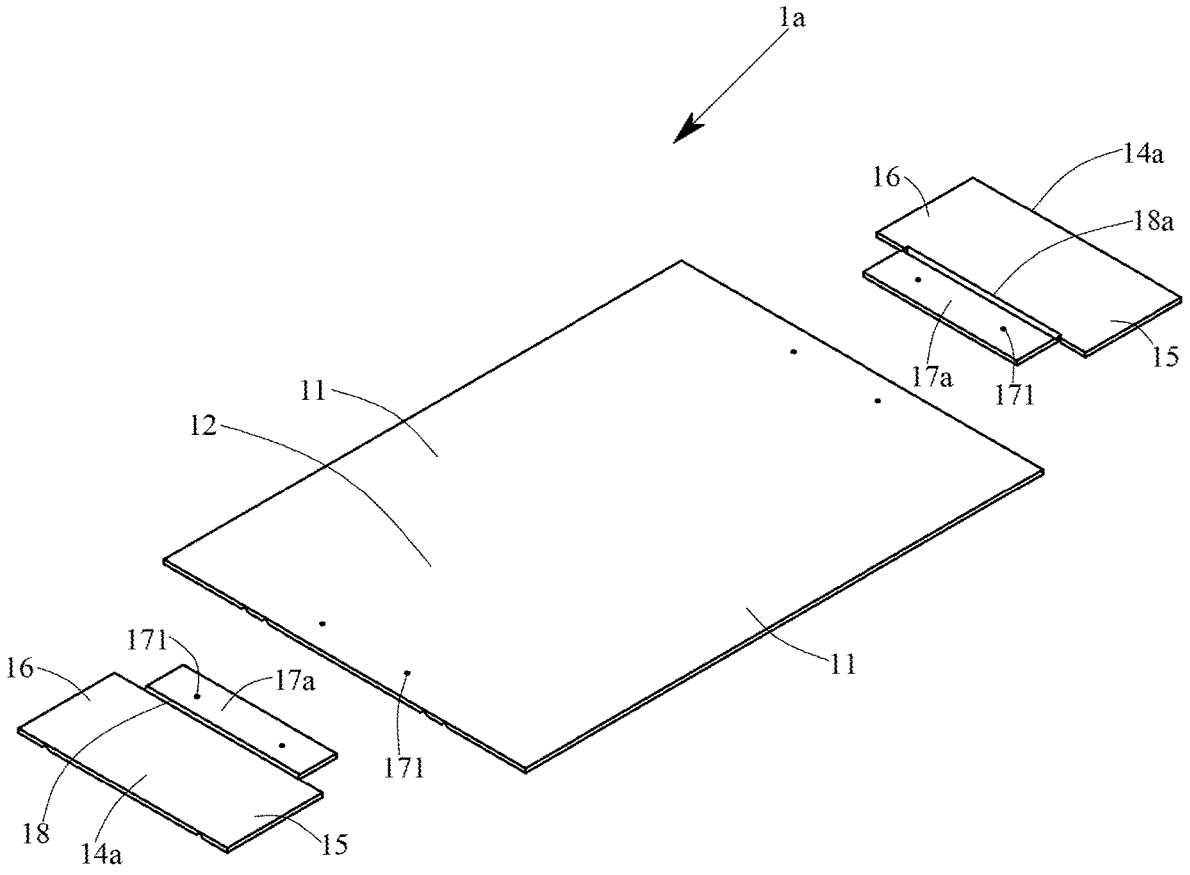
FIG. 2 is an exploded view illustrating a state in which a verso of the corrugated cardboard coffin of FIG. 1 is disassembled.
Figure 3:
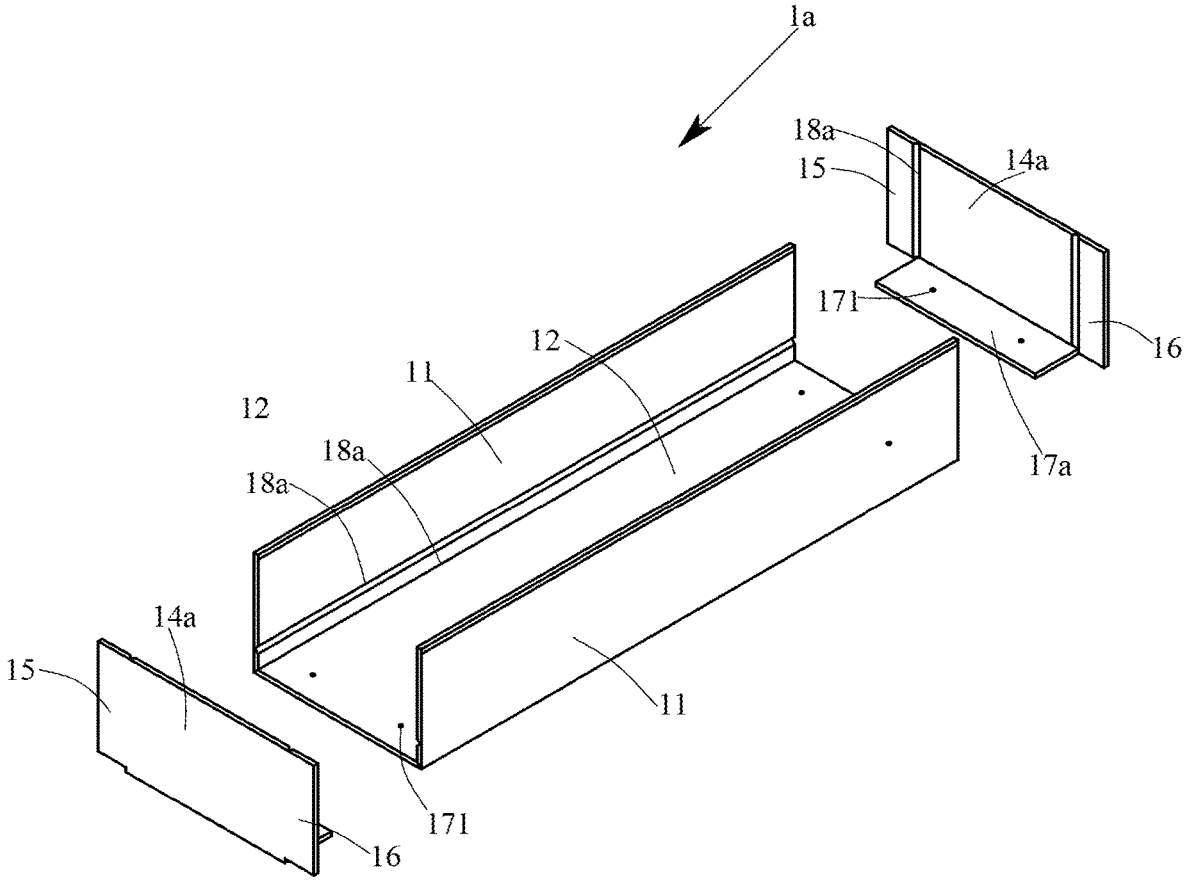
FIG. 3 is a perspective view illustrating a process of assembling the corrugated cardboard coffin of FIG. 1.

As illustrated in FIG. 1, the first boards 14*a* and the second boards 15 are partitioned by cut portions 18*a*. Similarly, the first boards 14*a* and the third boards 16 are partitioned by cut portions 18*a*. As illustrated in FIG. 2, the first boards 14*a* and the fixed boards 17*a* are partitioned by the cut portion 18*a*. As illustrated in FIG. 1, the cut portion 18*a* that partitions the first board 14*a* and the second board 15 and the cut portion 18*a* that partitions the first board 14*a* and the third board 16 are provided on the one surface of the first board 14*a*. By contrast, as illustrated in FIG. 2, the cut portion 18*a* that partitions the first board 14*a* and the fixing board 17*a* is provided on the other surface of the first board 14*a*.

Figure 26:
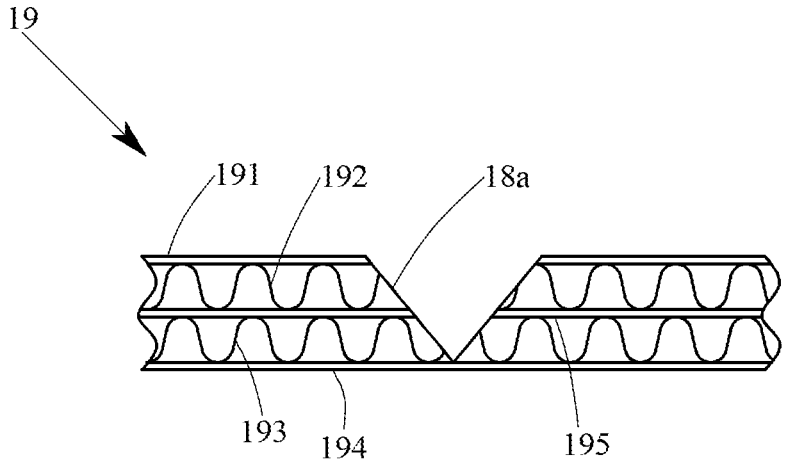
FIG. 26 is a cross-sectional view illustrating an example of a cutout portion provided in the corrugated cardboard constituting the corrugated cardboard coffin.

As illustrated in FIG. 26, a corrugated cardboard 19 constituting the coffin 1*a* of the first embodiment has a first liner 191, a first corrugated portion 192, a second corrugated portion 193, a second liner 194, and a partition layer 195 separating the first corrugated portion 192 and the second corrugated portion 193. In the coffin 1*a* of the first embodiment, the first liner 191, the first corrugated portion 192, the partition layer 195, and the second corrugated portion 193 are cut with the second liner 194 left so that the corrugated cardboard can be easily bent and rotated. Thus, when the cardboard is folded toward the second liner 194, it can be folded until the second liner and the second liner are in contact with each other. The corrugated cardboard constituting the coffin may be a single layer or multiple layers, however, it is preferable to cut a groove so as to leave the liner opposite to a side into which the groove is cut. In an example of FIG. 26, the first liner 191, the second liner 194, and the partition layer 195 are made of board paper. The first corrugated portion 192 and the second corrugated portion 193 have a shape obtained by repeatedly bending paper into a wave shape.

Figure 27:
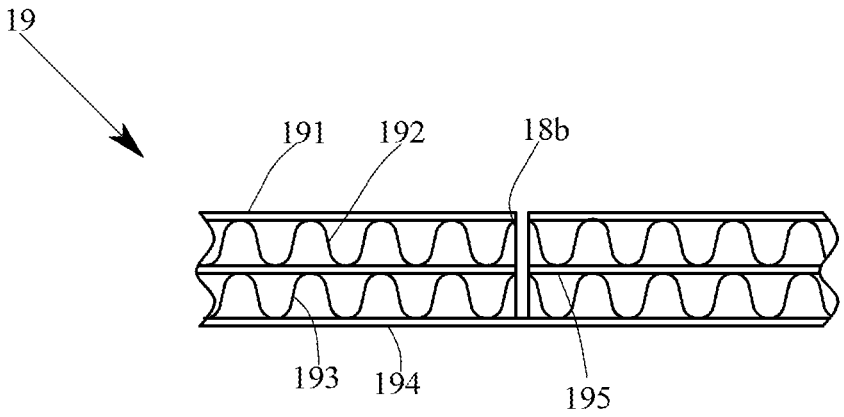
FIG. 27 is a cross-sectional view illustrating another example of the cutout portion provided in the corrugated cardboard constituting the corrugated cardboard coffin.

As illustrated in FIG. 26, the cut portion 18*a* may be configured, for example, such that a linear groove having a V-shaped cross-section is formed in the corrugated cardboard constituting the coffin. Or, a cut portion 18*b* may be configured such that a linear I-shaped groove is formed as illustrated in FIG. 27. In a case of the V-shaped groove, a maximum rotation range of about 270 degrees is obtained. With the I-shaped groove, the maximum rotation range of about 180 degrees is obtained. By arranging a V-shaped cut portion 18*a* between the first board 14*a* and the second board 15 and another V-shaped cut portion 18*a* between the first board 14*a* and the third board 16, the second board 15 and the third board 16 are easily positioned in a state of extending in the longitudinal direction of the coffin 1*a*. Thus, an assembling work of the coffin 1*a* can be made efficient, and rigidity of the coffin 1*a* can be increased.

In the coffin 1*a* of the first embodiment, the cut portion 18*a* is provided on a boundary between each of the sidewalls 11 and the bottom board 12 at a lower end of the sidewall in the longitudinal direction of the coffin. The cut portion is provided in an inner surface, that is, the one surface of the coffin 1*a*. It is configured such that the sidewalls 11 are raised from a state in which the sidewalls 11 are developed as illustrated in FIG. 1, and the sidewalls 11 are easily bent to extend upward. It is preferable to provide the V-shaped cut portion on the boundary between each of the sidewalls 11 and the bottom board 12 because the sidewall 11 can be easily positioned and set to extend upwardly.

In the coffin 1*a* of the first embodiment, as illustrated in FIG. 12, a center C of operation for rotating each of the sidewalls 11 in the direction approaching the bottom board 12 is disposed away from the bottom board 12. In an example of FIG. 12, the center C of the rotation operation is disposed away from the bottom board 12 by a length H that is sufficient to house the first boards 14*a*, the second boards 15, the third boards 16, and exterior materials 20 described later between the bottom board 12 and the fell-down sidewalls 11. Thus, the first boards 14*a*, the second boards 15, and the third boards 16 can be housed without difficulty between the bottom board 12 and the fell-down sidewalls 11. The length H can be, for example, in a range of 10 to 300 mm or 10 to 200 mm. The position of the rotation center C can be determined by a position in which the cut portion 18*a* is provided. In the coffin 1*a* of the first embodiment, the cut portion 18*a* that defines the center C of the rotation operation is provided in the longitudinal direction of the coffin 1*a* on the inner surface of the coffin 1*a*, that is, on the one surface of each of the sidewalls 11.

As illustrated in FIG. 10, the coffin 1*a* of the first embodiment is configured to house the exterior materials 20 described below between the bottom board 12 and the fell-down sidewalls 11. That is, a space 21 is provided between the first board 14*a* disposed in the one gable 12 and the first board 14*a* disposed in the other gable 12 to house the exterior materials 20 removed from the gables 12. In the coffin 1*a* of the first embodiment, as illustrated in FIG. 10 and FIG. 11, a lid 22 can be, for example, stored or transported in a state of being stacked on the pair of fell-down sidewalls 11.

In the coffin 1*a* of the first embodiment, as illustrated in FIG. 5, in the assembled state of the coffin 1*a*, the other surface of each of the second board 15 and an inner surface of the one sidewall 11, and the other surface of each of the third boards 16 and an inner surface of the other sidewall 11 are connected to each other. The second boards 15 and the third boards 16 prevent the sidewalls 11 from falling inward in the assembled state of the coffin 1*a*. The sidewalls 11 can be connected to the second boards 15 or the third boards 16 by appropriate means such as an adhesive, a gluing agent, a dowel, a screw, or a staple.

In the coffin 1*a* of the first embodiment, as illustrated in FIGS. 4 and 5, as the exterior materials 20, each of corrugated cardboards 202 fitted inside protruding frames 201 is fixed to the outside of the corresponding first board 14*a*. The corrugated cardboard 202 may have a decorative sheet attached to the outer side of the coffin 1*a*. As the decorative sheet, for example, the decorative sheet having a woodgrain pattern or an arbitrary color can be used. In the coffin 1*a* of the first embodiment, the first boards 14*a* function as reinforcements that increase strength around the gables 12. Since each of the exterior materials 20 described above is fixed to the outside of the corresponding first board 14*a*, the exterior material 20 can also increase the rigidity of the coffin 1*a*. The protruding frame 201 has a protrusion that protrudes in the longitudinal direction of the coffin along an edge of the frame.

In the coffin 1*a* of the first embodiment, as illustrated in FIG. 5, a height of the protruding frame 201 of each of the exterior materials 20 is larger than a height of the sidewalls 11 of the coffin 1*a*. Therefore, a gap T is formed between an inner edge of the protruding frame 201 and an upper end of the sidewalls 11. The gap T is set to a size that allows an end of the lid 22 to fit into the gap T, the lid 22 being configured to close an opening of the coffin 1*a*. Therefore, by fitting the end of the lid 22 into the gap T, the lid 22 can be stably fixed to a coffin body. Furthermore, according to this structure, the corrugated cardboard constituting the sidewalls 11, the frame of the exterior material 20, and a protruding frame of the lid 22 do not overlap each other. Since the overlapping portions on the corrugated cardboards are less formed, gaps are less likely formed between the lid 22 and the coffin body, and appearance of the coffin 1*a* can be finished cleanly.

When an operator grips and transports the coffin 1*a*, a large load is likely to apply to periphery of the gables 13. In the coffin 1*a* of the first embodiment, each of the gables 13 has a double structure of the bottom board 12 and the fixing board 17*a*, a double structure of the first board 14*a* and the exterior material 20, and a double structure of the sidewalls 11, the second board 15, and the third board 16. Thus, strength of the coffin 1*a* in the periphery of the gables 13 is increased.

The first boards 14*a*, the second boards 15, and the third boards 16 provided to the gables 13, or both ends of the pair of sidewalls 11 are covered with the exterior materials 20. Therefore, ends obtained by cutting the corrugated cardboard, the gap between the corrugated cardboards, and the like do not appear in the appearance of the coffin. The coffin of the first embodiment is not only excellent in strength in the gables, but also excellent in appearance in the gables.

In the coffin of the first embodiment, each of the sidewalls 11 is provided with the cut portion 18*a* for rotating the sidewall 11. As described above, the exterior materials 20 are fitted into the gables 13. Deformation of the coffin 1*a* due to provision of the cut portions 18*a* in the sidewalls 11 is suppressed by the protruding frames 201 of the exterior materials 20. Furthermore, the first boards 15 and the second boards 16 are arranged inside the pair of sidewalls 11 in the gables 13. This configuration also suppresses deformation of the coffin 1*a* due to the provision of the cut portions 18*a* in the sidewalls 11.

Second Embodiment

FIGS. 13 to 16 illustrate the second embodiment of a corrugated cardboard coffin. Different portions from the corrugated cardboard coffin 1*a* of the first embodiment will be described below. In FIGS. 13 to 16, the same reference numerals as those used in FIGS. 1 to 12 are used for the same components as the coffin 1*a* of the first embodiment.

A coffin 1*b* of the second embodiment is different from the coffin 1*a* according to the first embodiment in that the first boards 14*b* are integrally formed with a bottom board 12*b*, and the fixing boards 17*a* are not provided. Each of the first boards 14*b* includes the second board 15 and the third board 16 which are the same components as those of the coffin 1*a*.

Figure 13:
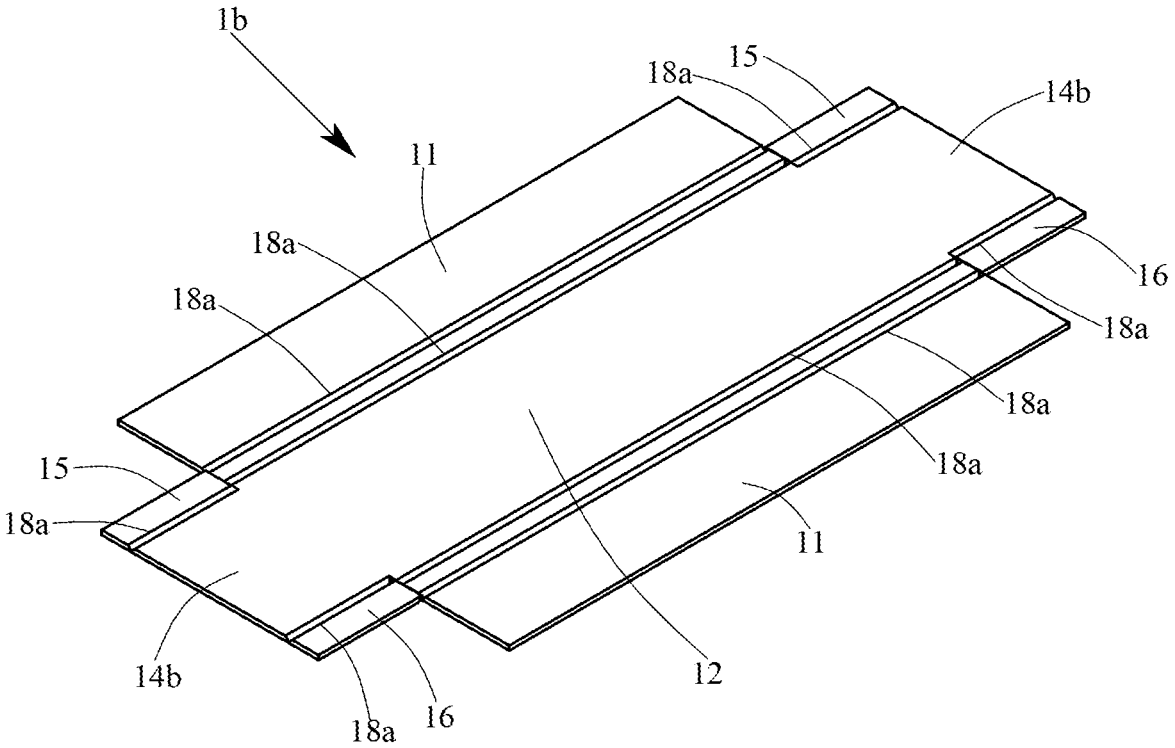
FIG. 13 is a development view illustrating a state in which an obverse of a corrugated cardboard coffin according to a second embodiment is disassembled.
Figure 14:
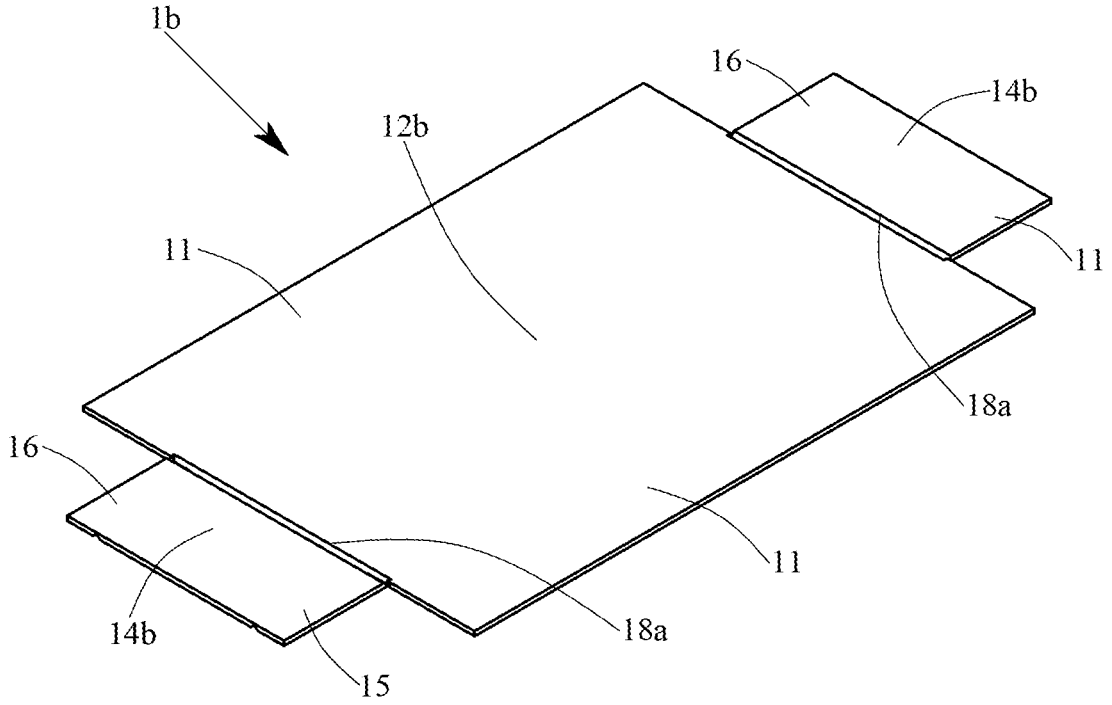
FIG. 14 is an exploded view illustrating a state in which a verso of the corrugated cardboard coffin of FIG. 13 is disassembled.
Figure 15:
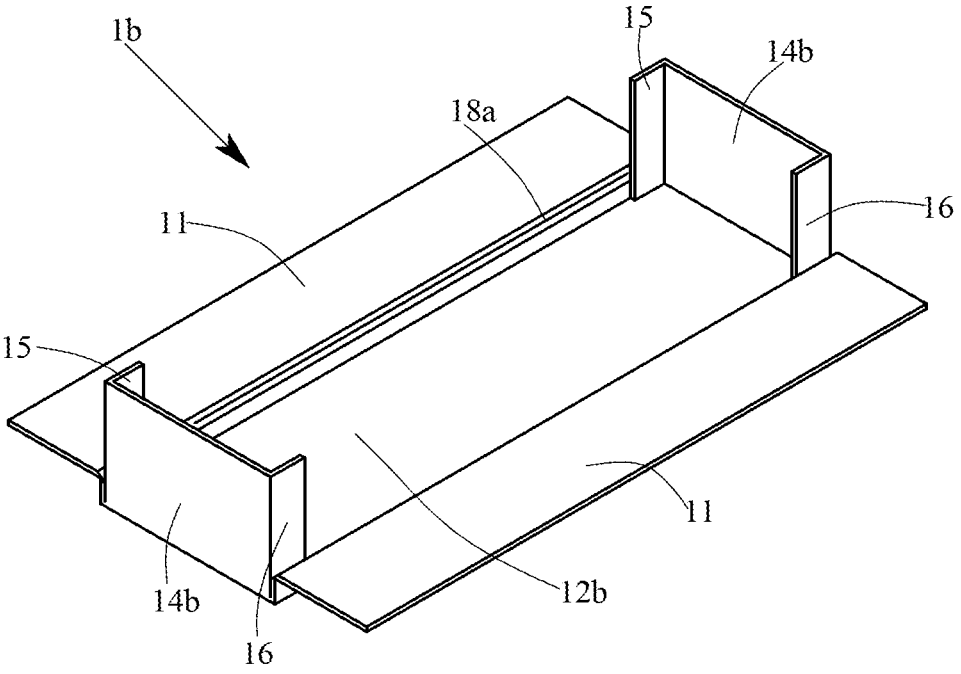
FIG. 15 is a perspective view illustrating the process of assembling the corrugated cardboard coffin of FIG. 13.
Figure 16:
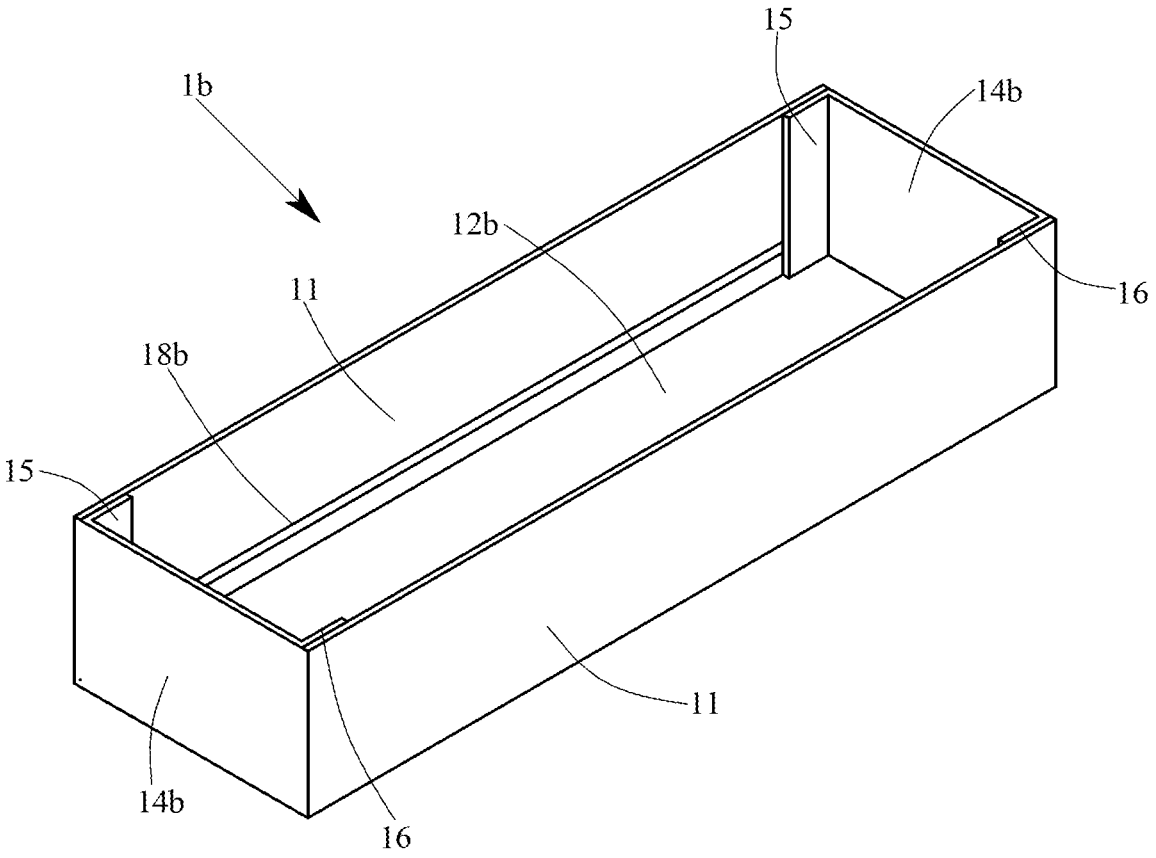
FIG. 16 is a perspective view illustrating the process of assembling the corrugated cardboard coffin of FIG. 13, and is the perspective view illustrating a step subsequent to FIG. 15.
Figure 17:
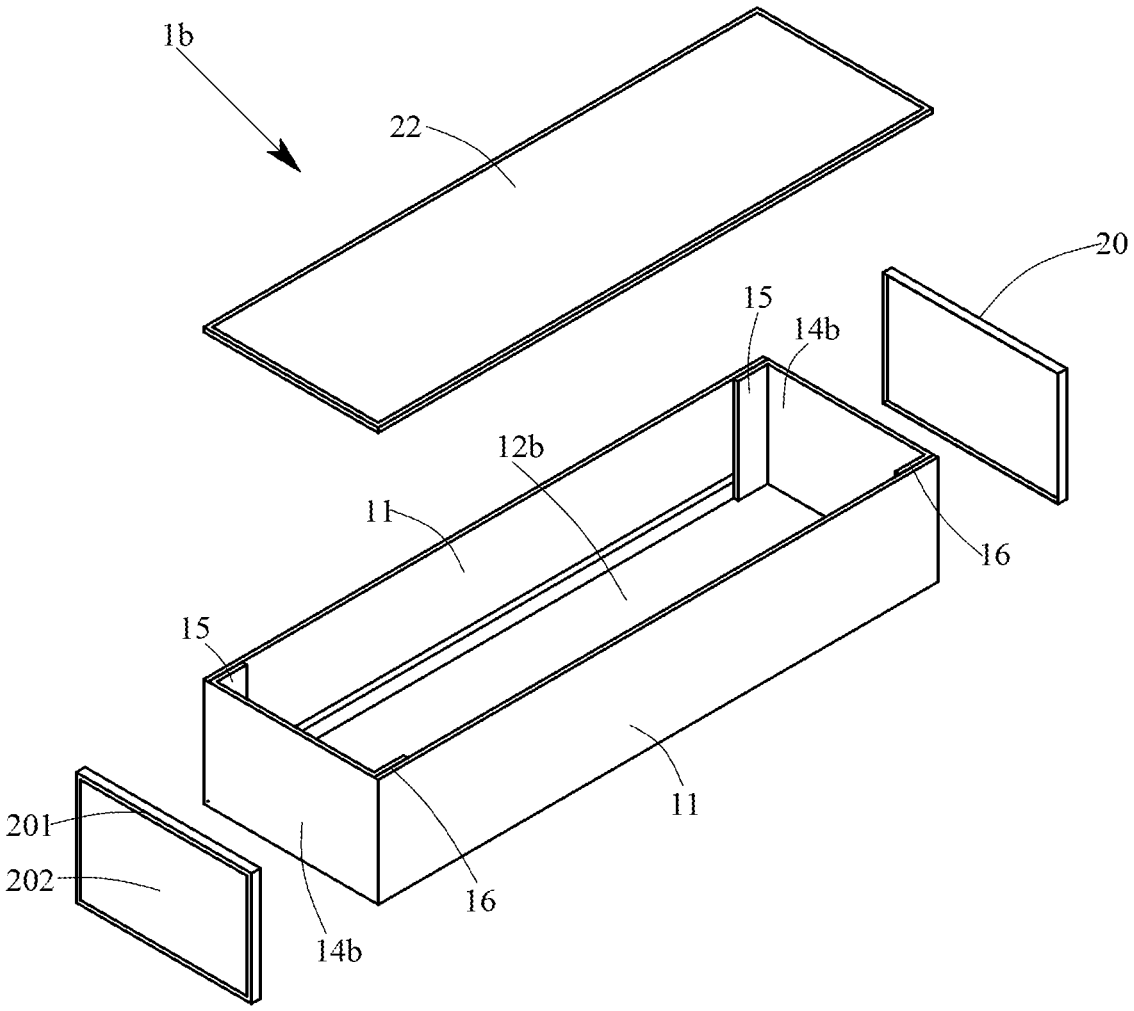
FIG. 17 is a perspective view illustrating the process of assembling the corrugated cardboard coffin of FIG. 13, and is the perspective view illustrating a step subsequent to FIG. 16.
Figure 18:
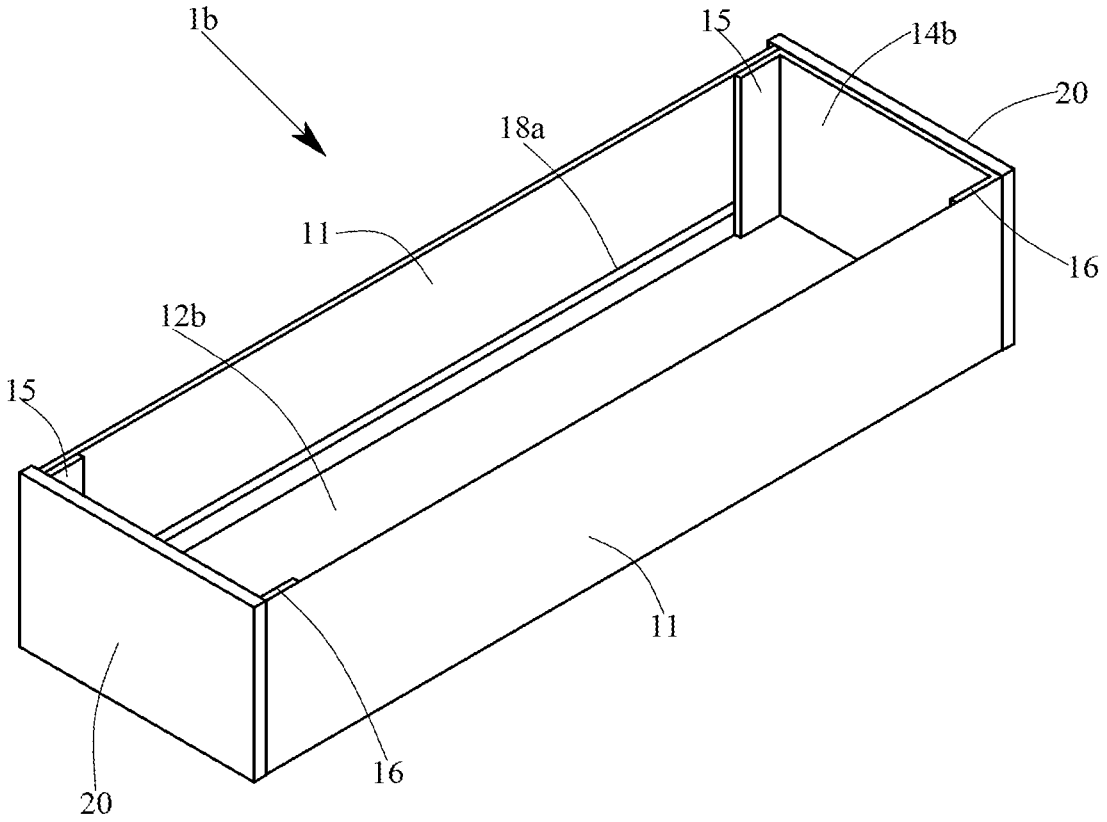
FIG. 18 is a perspective view illustrating the coffin body in the assembled state of the corrugated cardboard coffin of FIG. 13.
Figure 19:
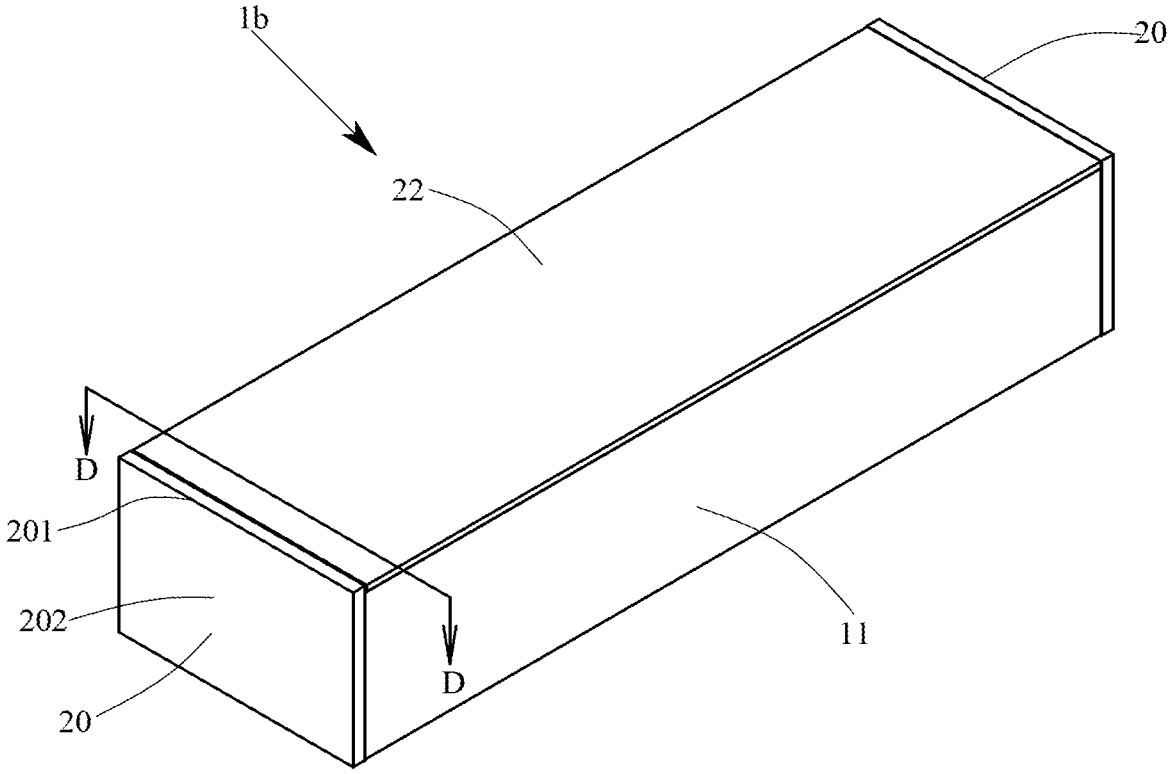
FIG. 19 is a perspective view illustrating the state in which the lid is attached to the coffin body of FIG. 18.
Figure 20:
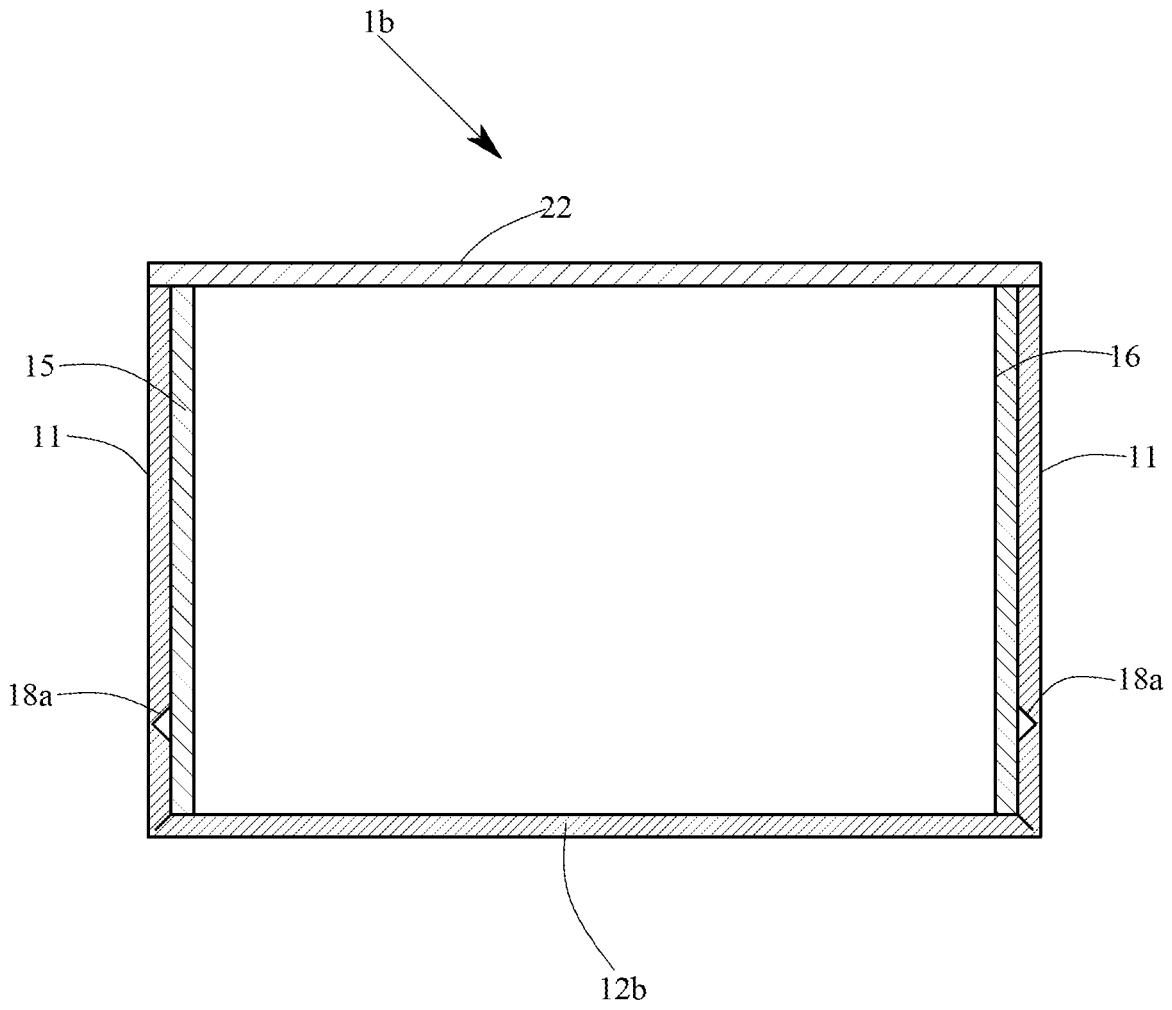
FIG. 20 is a cross-sectional view taken along a line DD of FIG. 19.
Figure 21:
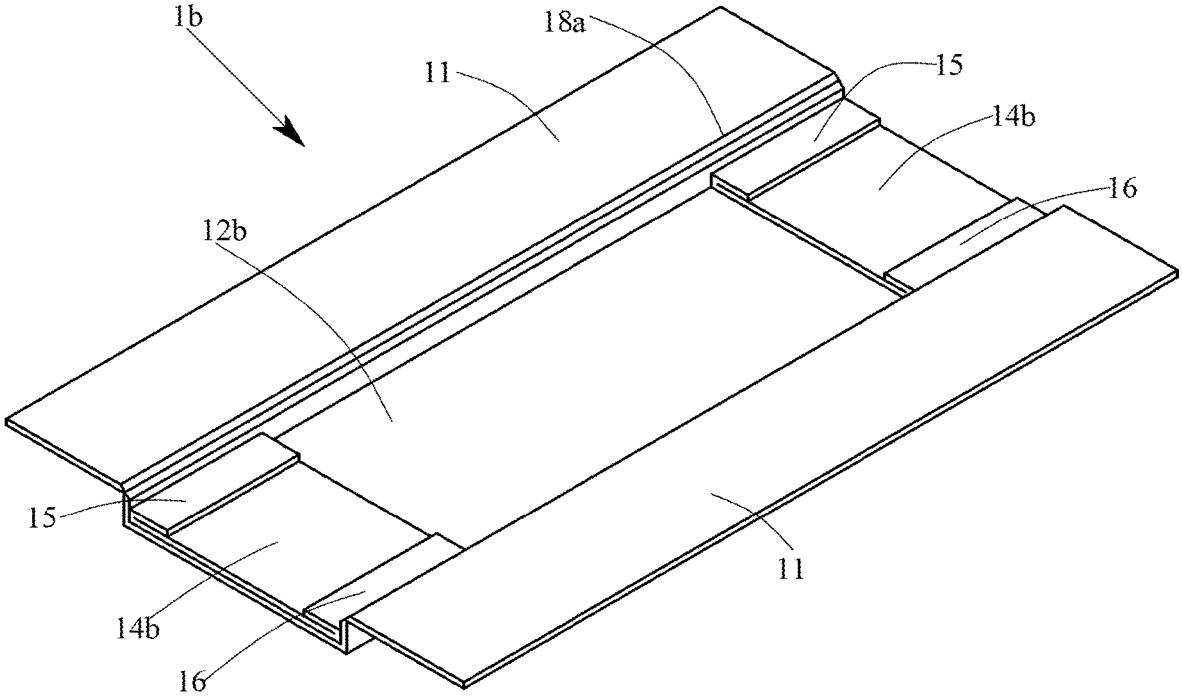
FIG. 21 is a perspective view illustrating the process in which the corrugated cardboard coffin according to the first embodiment, which has been assembled, is folded.
Figure 22:
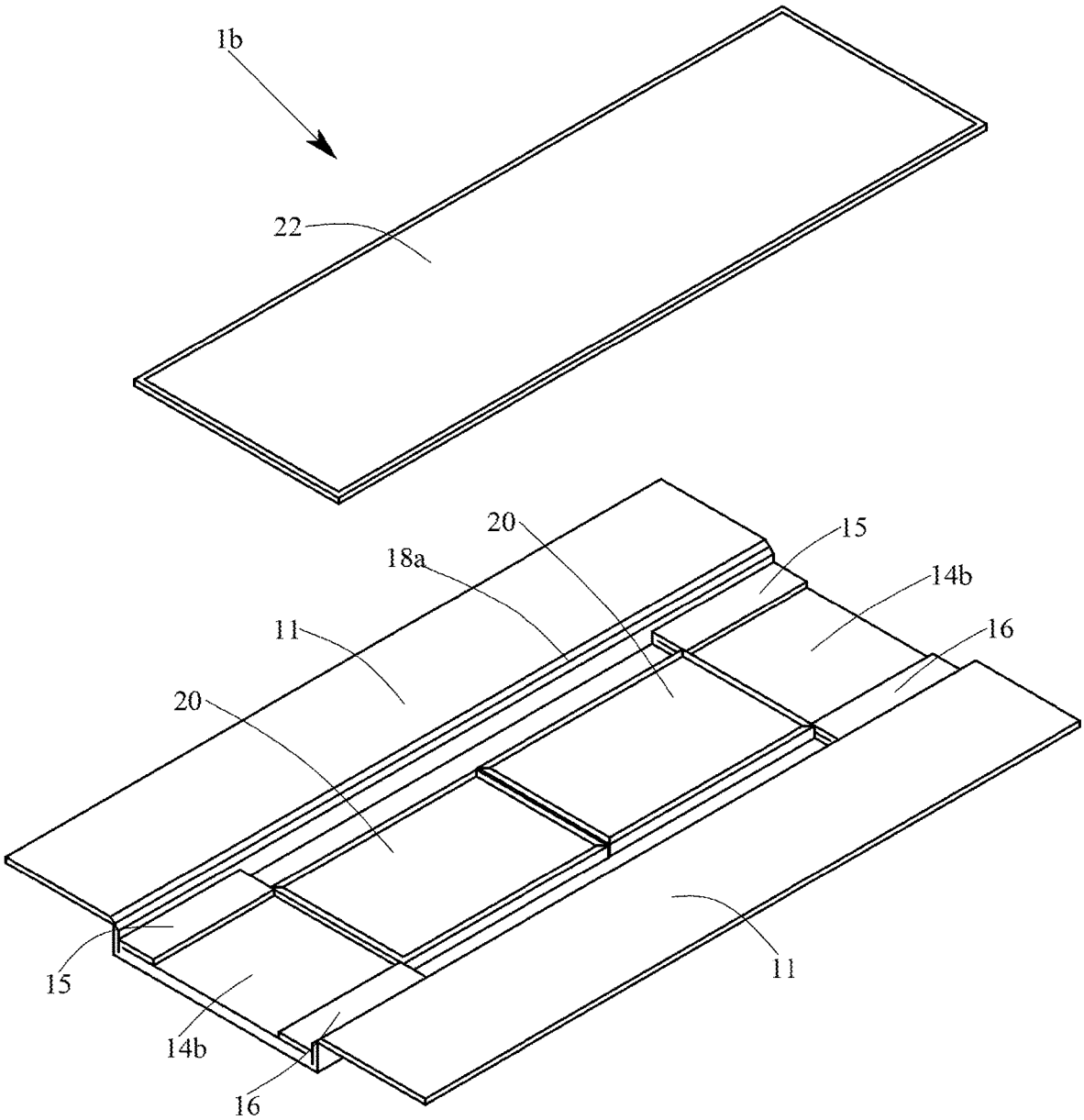
FIG. 22 is a perspective view illustrating the process in which the corrugated cardboard coffin according to the second embodiment is folded.
Figure 23:
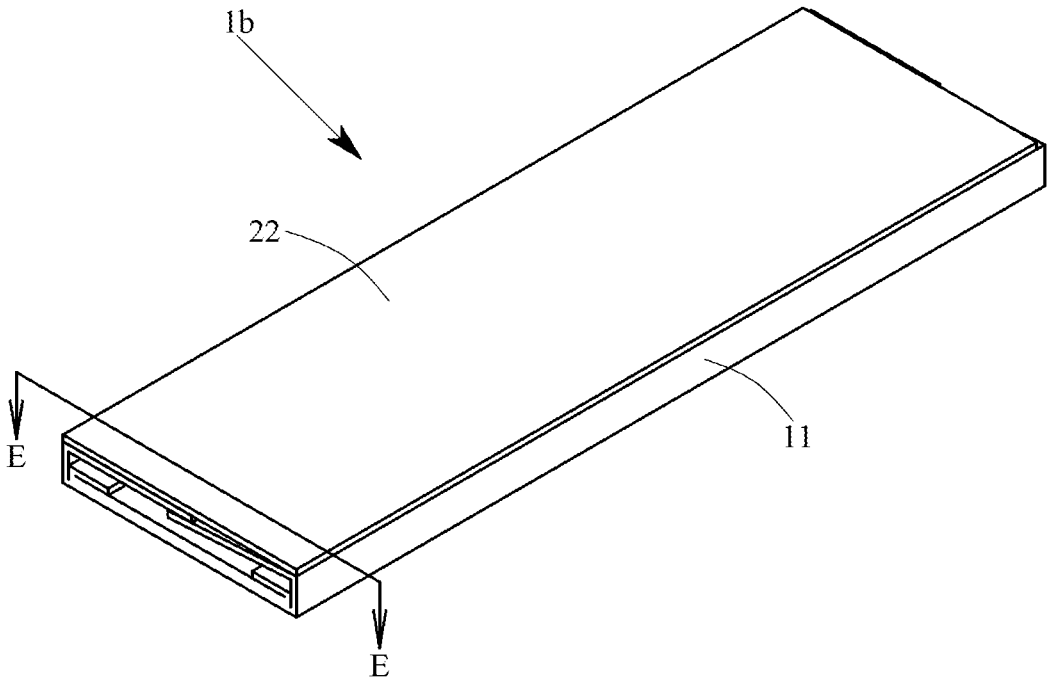
FIG. 23 is a perspective view illustrating the process in which the corrugated cardboard coffin according to the second embodiment is folded, and is the perspective view illustrating a step subsequent to FIG. 22.

As illustrated in FIG. 13 and FIG. 14, the first boards 14*b* of the coffin 1*b* of the second embodiment are continuous with the bottom board 12*b*. The first boards 14*b* and the bottom board 12*b* are formed of a piece of corrugated cardboard. Similarly, the first boards 14*b*, the second boards 15, and the third boards 16 are also formed of a piece of corrugated cardboard.

As illustrated in FIGS. 13 and 14, the first boards 14*b* are partitioned by providing the cut portions 18*a* on boundaries with the bottom board 12*b*. Each of the cut portions 18*a* is provided on the other surface of the corresponding first board 14*b* as in the case of the coffin 1*a*.

The cut portion 18*a* leaves the second liner 194 located on a side opposite to the side into which the groove is cut. Therefore, the first boards 14*b* can be rotated until the first boards 14*b* contact the bottom board 12*b* similarly to the first boards 14*a*.

As illustrated in FIGS. 13 to 24, the coffin 1*b* of the second embodiment uses the rotation operation of the first boards 14*b*, the second boards 15, the third boards 16, and the pair of sidewalls 11, so that the coffin 1*b* can be assembled or folded in the same manner as the coffin 1*a* of the first embodiment.

Figure 24:
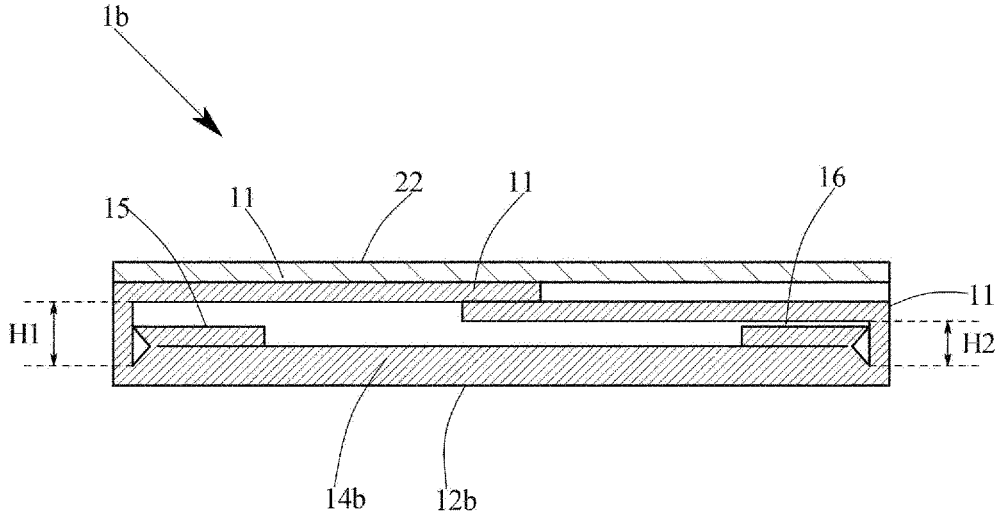
FIG. 24 is a cross-sectional view taken along a line EE in FIG. 23.

In the coffin 1*b* of the second embodiment, as illustrated in FIG. 24, among the pair of sidewalls 11, a distance H1 between the bottom board 12*b* and the rotation center C of the one sidewall is different from a distance H2 between the bottom board 12*b* and the rotation center C of the other sidewall 11. Specifically, the distance H2 is smaller than the distance H1. Thus, as illustrated in FIG. 24, when the sidewalls 11 are rotated with respect to the bottom board 12*b*, the fell-down sidewalls 11 can be folded in a substantially horizontal direction. The sidewalls 11 can be in a substantially horizontal state during storage or the like, so that the coffin 11*b* is less likely to be broken when the folded coffins are stacked.

Third Embodiment

FIG. 25 illustrates a third embodiment of a corrugated cardboard coffin. The different portions from the corrugated cardboard coffin 1*a* of the first embodiment will be described below. In FIG. 25, the same reference numerals as those used in FIGS. 1 to 12 are used for the same components as the coffin 1*a* of the first embodiment.

As illustrated in FIG. 25, a coffin 1*c* of the third embodiment does not have the exterior materials 20, and thus the first boards 14*a* function as exterior materials that close the openings provided in the gables. The above-described decorative sheet or cloth may be laminated on an exterior surface side of each of the first boards 14*a*.

As illustrated in FIG. 25, the coffin 1*c* of the third embodiment includes a lid 22*c* having a protruding frame 221. By fitting an upper end of the coffin body into the protruding frame 221 of the lid 22*c*, the lid 22*c* can be attached to the coffin body in a stable state. The lid 22*c* may be plate-shaped and provided with a hook-and-loop fastener on the back surface. The lid 22*c* can be fixed to the coffin body by the hook-and-loop fastener provided to the coffin body that engages with the hook-and-loop fastener provided to the lid 22*c*.

In the coffins according to the first to third embodiments, the cross-section of the coffin body is formed in a rectangular shape by the sidewalls and the bottom board. The shape of the coffin body is not limited to this. For example, the cross-section of the coffin may be an ellipse or a circle, or the shape of the coffin viewed from above may be a circle, or a polygon such as a pentagon or a hexagon.

In the coffins of the first to the third embodiments, each of the first boards has the rectangular shape that closes the opening of the corresponding gable. The shape of the first board is not limited to this. For example, the first board may be circular or may be smaller than a size of the opening. Similarly, the shape of the second board, the third board, or the fixing board is not limited to that of the above embodiments, and may be, for example, elliptical.

In the coffins according to the first embodiment and the second embodiment described above, the exterior materials disposed on the gables have the protruding frames. The shape of the exterior material is not limited to this. For example, the exterior materials may be corrugated cardboards without protruding frames, or may be formed of cloth or the like.

In the coffin of the first embodiment, each of the fixing portions has a rectangular shape the longitudinal direction of which is located in the short direction of the coffin in a plan view. The shape of the fixing portion is not limited to this, but only needs to be a shape that can fix the first board to the bottom board. The fixing portion can have, for example, a plate shape such as a trapezoidal shape, an elliptical shape, or a circular arc shape.

REFERENCE SIGNS LIST

1*a* corrugated cardboard coffin
11 sidewall
13 gable
14*a* first board
14*b* first board
15 second board
16 third board
17 bottom board
12*b* bottom board
18*a* cut portion
18*b* cut portion

The invention claimed is:

1. A corrugated cardboard coffin comprising:

a pair of sidewalls extending in a longitudinal direction of the coffin;

a bottom board connecting the pair of sidewalls; and a first board disposed in each gable of the coffin, wherein the first board extends in an extending direction of the gable, and includes a second board and a third board extending in the extending direction of the sidewalls, a first cut portion is provided between the bottom board and each of the pair of sidewalls, the pair of sidewalls are rotatable at the first cut portion as an axis of rotation in a direction approaching the bottom board, the first board is supported by the bottom board so as to be rotatable in the direction approaching the bottom board, the second board and the third board are supported by the first board so as to be rotatable in a direction approaching one surface or the other surface of the first board, a second cut portion is provided on each of the pair of sidewalls, the second cut portion is disposed away from the bottom board in a direction perpendicular to a longitudinal end of the bottom board, and the second cut portion is parallel to said first cut portion, the first board, the second board, and the third board are configured to be housed in a space formed between the bottom board and the sidewalls when the second board and the third board are rotated in the direction approaching one surface or the other surface of the first board, the first board is rotated in the direction approaching the bottom board, and the pair of sidewalls are rotated at the second cut portion as an axis of rotation in the direction approaching the bottom board to form the said space.

2. The corrugated cardboard coffin according to claim 1, wherein a third cut portion is provided between the first board and the second board, and a fourth cut portion is provided between the first board and the third board at a respective rotation axis in the corrugated cardboard constituting the coffin.

3. The corrugated cardboard coffin according to claim 1, wherein an exterior material is fixed to an outside of each of the first boards disposed in the corresponding gables, and the first board functions as a reinforcement, the exterior material has a corrugated cardboard fitted inside a protruding frame, the protruding frame has a protrusion that protruded in a longitudinal direction of the coffin along an edge of a frame.

4. The corrugated cardboard coffin according to claim 1, wherein the first board disposed in the gable is configured to function as an exterior material that closes the gable.

5. The corrugated cardboard coffin according to claim 1, wherein, in an assembled state of the coffin, the first board extends upwardly of the coffin, the second board and the third board extend in the longitudinal direction of the coffin, the second board and one of the pair of sidewalls are connected to each other, and the third board and the other of the pair of sidewalls are connected to each other.

6. The corrugated cardboard coffin according to claim 1, wherein, among the pair of sidewalls, a distance between the bottom board and the second cut portion on one of the pair of sidewalls is smaller than a distance between the bottom board and the second cut portion on the other of the pair of sidewalls.

7. The corrugated cardboard coffin according to claim 1, wherein the second cut portion is parallel to the longitudinal end of the bottom board.

8. The corrugated cardboard coffin according to claim 1, wherein a distance between the second cut portion and the bottom board is larger than a sum of a thickness of the first board and a thickness of the second board or the third board and the distance between the second cut portion and the bottom board is smaller than a height of each of the pair of sidewalls.

9. The corrugated cardboard coffin according to claim 1, wherein a distance between the second cut portion and the bottom board is in a range of 10 to 300 mm.

* * * * *